US007273834B2

(12) United States Patent
Rosenbaum et al.

(10) Patent No.: US 7,273,834 B2
(45) **Date of Patent: *Sep. 25, 2007**

(54) LUBRICANT BLENDS WITH LOW BROOKFIELD VISCOSITIES

(75) Inventors: John M. Rosenbaum, Richmond, CA (US); Stephen J. Miller, San Francisco, CA (US); Joseph M. Pudlak, Vallejo, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 549 days.

This patent is subject to a terminal disclaimer.

(21) Appl. No.: 10/847,997

(22) Filed: May 19, 2004

(65) Prior Publication Data

US 2005/0261145 A1 Nov. 24, 2005

(51) Int. Cl.
*C10M 145/14* (2006.01)
*C10M 105/34* (2006.01)

(52) U.S. Cl. ..... 508/469; 518/715; 508/463; 508/10

(58) Field of Classification Search ..... 508/463, 508/469, 110; 518/715
See application file for complete search history.

(56) References Cited

U.S. PATENT DOCUMENTS

| | | | |
|---|---|---|---|
| 3,773,650 | A | 11/1973 | Hislop et al. |
| 3,775,288 | A | 11/1973 | Eagen et al. |
| 3,852,207 | A | 12/1974 | Stangeland et al. |
| 3,904,513 | A | 9/1975 | Fischer et al. |
| 4,157,294 | A | 6/1979 | Iwao et al. |
| 4,347,121 | A | 8/1982 | Mayer et al. |
| 4,440,871 | A | 4/1984 | Lok et al. |
| 4,477,333 | A | 10/1984 | Hafez |
| 4,568,663 | A | 2/1986 | Mauldin |
| 4,673,487 | A | 6/1987 | Miller |

(Continued)

FOREIGN PATENT DOCUMENTS

| | | | |
|---|---|---|---|
| EP | 0609079 | A1 | 8/1994 |

(Continued)

OTHER PUBLICATIONS

Gatto, V.J., et al., "The Influence of Chemical Structure on the Physical Properties and antioxidant Response of Cracked Base Stocks and Polyalphaolefins", *J. Synthetic Lubrication* 19(1): 3-18 (2002).

(Continued)

*Primary Examiner*—Vasu Jagannathan
*Assistant Examiner*—James Goloboy
(74) *Attorney, Agent, or Firm*—E. Joseph Gess

(57) ABSTRACT

Lubricant blends and finished gear oils comprising a Fischer-Tropsch derived lubricant base oil fraction, a petroleum derived base oil, and a pour point depressant are provided. The Fischer-Tropsch derived lubricant base oil fraction comprises less than 0.30 weight percent aromatics, greater than 5 weight percent molecules with cycloparaffinic functionality, and a ratio of weight percent of molecules with monocycloparaffinic functionality to weight percent of molecules with multicycloparaffnic functionality greater than 15. The petroleum derived base oils comprises greater than 90 weight percent saturates and less than 300 ppm sulfur and is preferably selected from the group consisting of a Group II base oil, a Group III base oil, and mixtures thereof. These lubricant blends have surprising low Brookfield viscosities at −40° C.

50 Claims, 2 Drawing Sheets

U.S. PATENT DOCUMENTS

| | | | | |
|---|---|---|---|---|
| 4,810,357 | A | 3/1989 | Chester et al. | |
| 4,943,424 | A | 7/1990 | Miller | |
| 5,135,638 | A | 8/1992 | Miller | |
| 5,158,665 | A | 10/1992 | Miller | |
| 5,208,403 | A | 5/1993 | Buchanan et al. | |
| 5,282,958 | A | 2/1994 | Santilli et al. | |
| 6,080,301 | A | 6/2000 | Berlowitz et al. | |
| 6,096,940 | A | 8/2000 | Wittenbrink et al. | |
| 6,190,532 | B1 | 2/2001 | Degnan et al. | |
| 6,420,618 | B1 | 7/2002 | Berlowitz et al. | |
| 6,475,960 | B1 | 11/2002 | Berlowitz et al. | |
| 6,506,297 | B1 | 1/2003 | Wittenbrink et al. | |
| 7,053,254 | B2 * | 5/2006 | Miller | 585/1 |
| 7,083,713 | B2 * | 8/2006 | Abernathy et al. | 208/18 |
| 2004/0154958 | A1 * | 8/2004 | Alexander et al. | 208/18 |

FOREIGN PATENT DOCUMENTS

| | | | |
|---|---|---|---|
| WO | 99/41332 | A1 | 8/1999 |
| WO | 02/070636 | A1 | 9/2002 |
| WO | 2004053030 | A2 | 6/2004 |

OTHER PUBLICATIONS

Barrer, R.M., "Zeolites, Science and Technology", edited by F.R. Rodrigues, et al., NATO ASI Series pp. 74-76, (1984).

Baerlocher, Ch., et al., "Atlas of Zeolite Framework Types", Fifth Edition Elsevier, pp. 10-15 (2001).

Anderson et al., Reactions on ZSM-5-Type Zeolite Catalysts, *Journal of Catalysts* 58: 114-130 (1979).

William A. Gruse and Donald R. Stevens, *Chemical Technology of Petroleum*, 3rd Edition, McGraw-Hill Book Co., New York, pp. 566-71 (1960).

Kramer, D.C., et al., "Influence of Group II & III Base Oil Composition on VI and Oxidation Stability", 1999 AIChE Spring National Meeting in Houston, (May, 1999).

U.S. Appl. No. 10/847,996 "Processes for Making Lubricant blends with low Brookfield Viscosities", Inventors Rosenbaum, Miller and Pudlak, filed May 19, 2004.

U.S. Appl. No. 10/301,391 "Blending of Low Viscosity Fischer-Tropsch Bse Oils with Conventional Bse Oils to Produce High Quality Lubricating Base Oils", Inventors Lok, Kramer, Rosenbaum and Pudlak, filed Nov. 20, 2003.

U.S. Appl. No. 10/744,389, "Composition of Lubricating Base Oil with high Monocycloparaffins and Low Multicycloparaffins", Inventors Abernathy, Kramer, Rosenbaum, Miller and Krug, filed Dec. 23, 2004.

U.S. Appl. No. 10/744,870, "Process for Manufacturing Lubricating Base Oil with High Monocycloparaffins and Low Multicycloparaffins", Inventors Abernathy, Kramer, Rosenbaum, Miller and Krug, filed Dec. 23, 2003.

U.S. Appl. No. 10/743,932, "Finished Lubricants Comprising Lubricating Base Oil with High Monocycloparaffins and low Multicycloparaffins", Inventors Abernathy, Kramer, Rosenbaum, Miller and Krug, filed Dec. 23, 2003.

U.S. Appl. No. 10/704,031, "Process for Improving the Lubricating Properties of Base Oils Using a Fischer-Tropsch Derived Bottoms", Inventor Miller, filed Nov. 7, 2003.

U.S. Appl. No. 10/835,219, "Method of Operating a Wormgear Drive at High Energy Efficiency", Inventors Ziemer, Abernathy, Rosenbaum, Miller and Okazaki, filed Apr. 29, 2004.

International Search Report from PCT/US05/17976; mailed Feb. 15, 2006.

* cited by examiner

LUBRICANT BLENDS WITH LOW BROOKFIELD VISCOSITIES

The present invention is directed to lubricant blends and finished gear oils comprising these lubricant blends, wherein the lubricant blends comprise a Fischer-Tropsch derived lubricant base oil fraction, a petroleum derived base oil, and a pour point depressant. The present invention is also directed to processes for making the same. These lubricant blends have good low temperature properties, including surprisingly low Brookfield viscosities.

BACKGROUND OF THE INVENTION

High performance automotive and industrial lubricants are in demand. Accordingly, lubricant manufacturers must provide finished lubricants that exhibit high performance properties. By way of example, premium quality gear oils have very tough low temperature performance specifications as specified by Brookfield viscosities at −40° C. Depending on the application in which the gear oils will be used, they may also need to exhibit a specific viscosity at 100° C. of greater than about 3 cSt.

Finished lubricants, including gear oils, consist of two general components: one or more lubricating base oils and additives. Lubricating base oil is the major constituent in these finished lubricants and contributes significantly to the properties of the finished lubricant. A few lubricating base oils can be used to manufacture a wide variety of finished lubricants by varying the mixtures of individual lubricating base oils and individual additives. By way of example, for gear oils, Brookfield viscosities are typically adjusted by the addition of pour point depressant to the base oil. Specific viscosities at 100° C. are controlled by blending one or more base oils having different viscosities together. To produce high performance finished lubricants, lubricant manufacturers are seeking higher quality lubricant base oil blend stocks.

A growing source of these high quality lubricant base oil blend stocks is synthetic lubricants. Synthetic lubricants include Fischer-Tropsch lubricant base oils, and in the search for high performance lubricants, attention has recently been focused on Fischer-Tropsch derived lubricants. Although Fischer-Tropsch lubricating base oils are desirable for their biodegradability and low amounts of undesirable impurities such as sulfur, the Fischer-Tropsch derived lubricants generally do not exhibit all of the desirable performance characteristics. Although it is well known in the art to improve performance characteristics through the use of additives, these additives are generally expensive and thus, can significantly increase the cost of the lubricant base oil. In addition, the addition of additives may not be sufficient to achieve the desired performance characteristics. By way of example, blends of one or more Fischer-Tropsch base oils with pour point depressants have very high Brookfield viscosities at −40° C. Furthermore, Fischer-Tropsch derived base oils generally are not available in all the desired ranges of viscosity at 100° C. for finished lubricants. Therefore, Fischer-Tropsch derived base oils must be blended with other base oils to optimize the viscosity.

It is well known in the art to produce synthetic lubricants and there have been many developmental attempts at producing synthetic lubricants with high performance characteristics. By way of example, WO 99/41332 and WO 02/070636 are directed to synthetic lubricant compositions used as automatic transmission fluids and methods for producing these synthetic lubricating base stocks. U.S. patent application Ser. No. 10/301391, filed on Nov. 20, 2002 and assigned to Chevron U.S.A., relates to lubricating base oil blends comprising a low viscosity Fischer-Tropsch derived base oil fraction and a higher viscosity conventional petroleum derived base oil fraction. U.S. patent application Ser. No. 10/743932, filed on Dec. 23, 2003 and assigned to Chevron U.S.A., discloses a finished lubricant comprising a blend of a Fischer-Tropsch lubricant base oil with high monocycloparaffins and low multicycloparaffins and an additional base oil selected from a group including petroleum derived base oils.

In spite of research into synthetic lubricants, there remains a need for synthetic lubricants comprising Fischer-Tropsch derived lubricant base oils that exhibit high performance, including good low temperature properties.

SUMMARY OF THE INVENTION

It has been discovered that the lubricant blends of the present invention, comprising Fischer-Tropsch derived lubricant base oil fraction, a petroleum derived base oil, and a pour point depressant, exhibit good low temperature properties including excellent low Brookfield viscosities at −40° C.

In one embodiment, the present invention relates to a lubricant blend. The lubricant blend of the present invention comprises from about 10 to about 80 weight percent based upon the total lubricant blend of a Fischer-Tropsch derived lubricant base oil fraction, from about 20 to about 90 weight percent based upon the total lubricant blend of a petroleum derived base oil, and from about 0.01 to 12 weight percent based upon the total lubricant blend of a pour point depressant, wherein the lubricant blend has a viscosity of about 3 cSt or greater at 100° C. and a Brookfield viscosity at −40° C. of less than 100,000 cP. The Fischer-Tropsch derived lubricant base oil fraction has a viscosity of between about 2 cSt and 20 cSt at 100° C. and the Fischer-Tropsch derived lubricant base oil fraction comprises: (i) less than 0.30 weight percent aromatics; (ii) greater than 5 weight percent molecules with cycloparaffinic functionality; and (iii) a ratio of weight percent of molecules with monocycloparaffinic functionality to weight percent of molecules with multicycloparaffinic functionality greater than 15. The petroleum derived base oil is selected from the group consisting of a Group II base oil, a Group III base oil, and mixtures thereof.

In another embodiment, the present invention relates to a lubricant blend comprising from about 10 to about 80 weight percent based upon the total lubricant blend of a Fischer-Tropsch derived lubricant base oil fraction, from about 20 to about 90 weight percent based upon the total lubricant blend of a petroleum derived base oil comprising greater than 90 weight percent saturates and less than 300 ppm sulfur, and from about 0.01 to 12 weight percent based upon the total lubricant blend of a pour point depressant. The lubricant blend has a viscosity of about 3 cSt or greater at 100° C. and a Brookfield viscosity at −40° C. of less than 100,000 cP. The Fischer-Tropsch derived lubricant base oil fraction has a viscosity of between about 2 cSt and 20 cSt at 100° C. and the Fischer-Tropsch derived lubricant base oil fraction comprises: (i) less than 0.30 weight percent aromatics; (ii) greater than 5 weight percent molecules with cycloparaffinic functionality; and (iii) a ratio of weight percent of molecules with monocycloparaffinic functionality to weight percent of molecules with multicycloparaffinic functionality greater than 15.

The present invention also relates to finished lubricants comprising the lubricant blends having excellent low Brookfield viscosities at −40° C. as provided herein. In one embodiment, the finished lubricant is a gear oil comprising the lubricant blends and at least one additive in addition to the pour point depressant.

In a further embodiment, the present invention relates to a process for producing a lubricant blend. The process comprises (a) providing a Fischer-Tropsch derived lubricant base oil fraction; (b) blending the Fischer-Tropsch derived lubricant base oil fraction with a petroleum derived base oil; and (c) isolating a lubricant blend having a Brookfield viscosity at −40° C. of less than 100,000 cP. The Fischer-Tropsch derived lubricant base oil fraction provided in the process has a viscosity of between about 2 cSt and 20 cSt at 100° C. and the Fischer-Tropsch derived lubricant base oil fraction comprises: (i) less than 0.30 weight percent aromatics; (ii) greater than 5 weight percent molecules with cycloparaffinic functionality; and (iii) a ratio of weight percent of molecules with monocycloparaffinic functionality to weight percent of molecules with multicycloparaffinic functionality greater than 15. The petroleum derived base oil blended with the Fischer-Tropsch derived lubricant base oil fraction is selected from the group consisting of a Group II base oil, a Group III base oil, and mixtures thereof.

In yet another embodiment, the present invention relates to a process for producing a lubricant blend comprising performing a Fischer-Tropsch synthesis to provide a product stream; isolating from the product stream a substantially paraffinic wax feed; hydroisomerizing the substantially paraffinic waxy feed using a shape selective intermediate pore size molecular sieve comprising a noble metal hydrogenation component under conditions of about 600° F. to about 750° F.; isolating an isomerized oil; and hydrofinishing the isomerized oil to provide a Fischer-Tropsch derived lubricant oil fraction. The Fischer-Tropsch derived lubricant base oil fraction has a viscosity of between about 2 cSt and 20 cSt at 100° C. and the Fischer-Tropsch derived lubricant base oil fraction comprises: (i) less than 0.30 weight percent aromatics; (ii) greater than 5 weight percent molecules with cycloparaffinic functionality; and (iii) a ratio of weight percent of molecules with monocycloparaffinic functionality to weight percent of molecules with multicycloparaffinic functionality greater than 15. The Fischer-Tropsch derived lubricant base oil fraction is blended with a petroleum derived base oil, selected from the group consisting of a Group II base oil, a Group III base oil, and mixtures thereof, and a pour point depressant, and a lubricant blend having a Brookfield viscosity at −40° C. less than 100,000 cP is isolated.

DETAILED DESCRIPTION OF THE INVENTION

Figure 1:
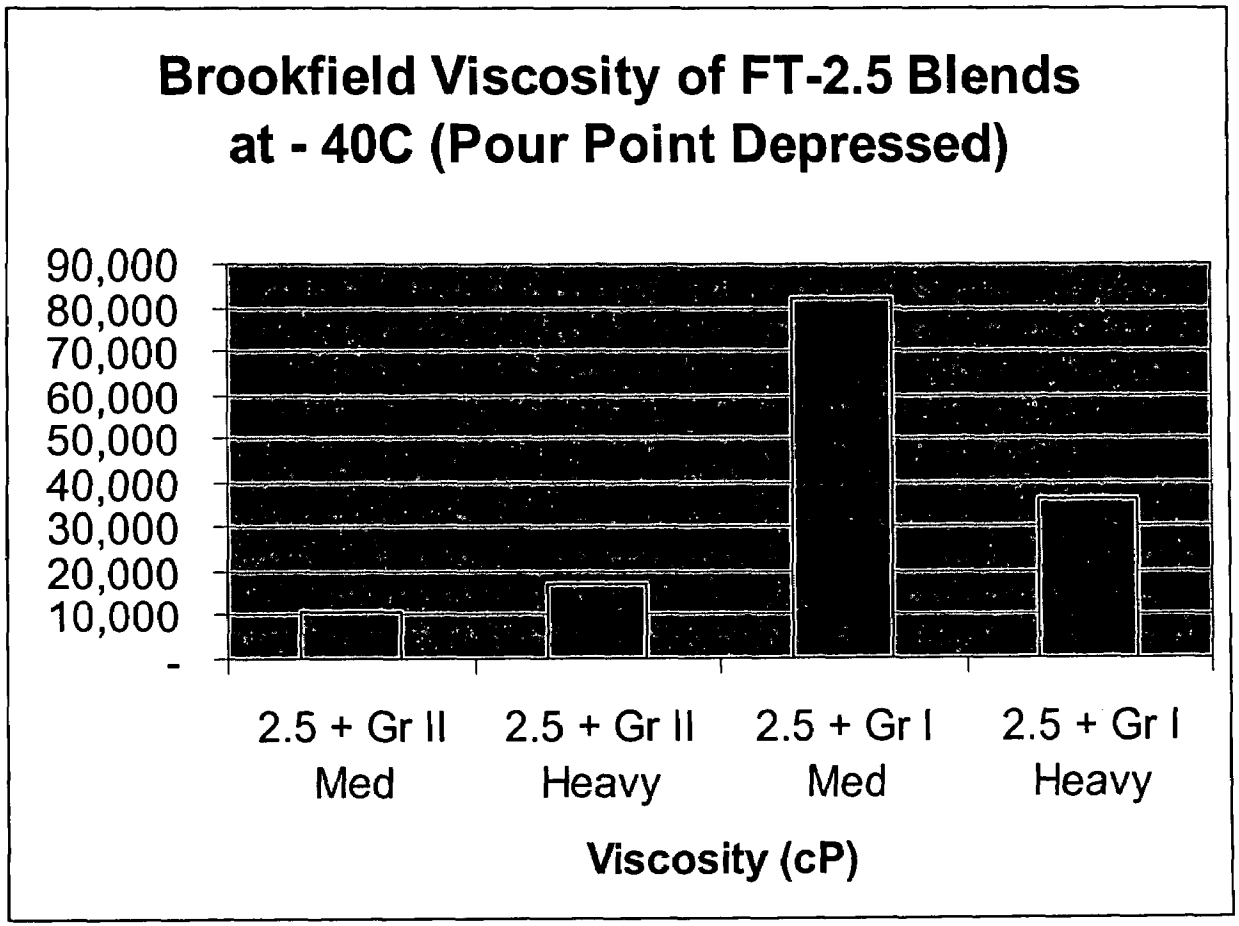
FIG. 1 illustrates the results of lubricant blends using a 2.5 cSt Fischer-Tropsch derived fraction (FT-2B).

Finished lubricants, including gear oils, comprise at least one lubricant base oil and at least one additive. Lubricant base oils are the most important component of finished lubricants, generally comprising greater than 70 weight % of the finished lubricants. Finished lubricants must meet the specifications for their intended application as defined by the concerned governing organization. The finished lubricants according to the present invention are intended for use as gear oils. Premium quality gear oils have very tough low temperature performance specifications as specified by Brookfield viscosities at −40° C.

The blended lubricants according to the present invention comprise at least one Fischer-Tropsch derived lubricant base oil fraction, a petroleum derived base oil, and a pour point depressant. These lubricant blends have a viscosity of about 3 cSt or greater at 100° C. and have good low temperature properties. In particular, the lubricant blends exhibit a Brookfield viscosities at −40° C. of less than 100,000 cP. In certain embodiments, the lubricant blends exhibit Brookfield viscosities at −40° C. of less than 90,000 cP, more preferably less than 60,000 cP, more preferably less than 50,000 cP, even more preferably less than 35,000 cP, even more preferably less than 25,000 cP, and even more preferably less than 15,000 cP. Accordingly, the blended lubricants of the present invention exhibit exceptional Brookfield viscosities at −40° C. Thus, the blended lubricants of the present invention can be used to make high quality gear oils.

The Fischer-Tropsch derived lubricant base oil fraction of the blended lubricant has a viscosity of between about 2 cSt and 20 cSt at 100° C. The Fischer-Tropsch derived lubricant base oil fraction comprises less than 0.30 weight percent aromatics, greater than 5 weight % molecules with cycloparaffinic functionality, and a ratio of weight percent of molecules with monocycloparaffinic functionality to weight percent of molecules with multicycloparaffinic functionality of greater than 15.

In a preferred embodiment, the Fischer-Tropsch derived lubricant base oil fraction comprises greater than 10 weight percent molecules with cycloparaffinic functionality. In another preferred embodiment, the Fischer-Tropsch derived lubricant base oil fraction comprises less than 0.30 weight percent aromatics, a weight percent of molecules with monocycloparaffinic functionality of greater than 10, and a weight percent of molecules with multicycloparaffinic functionality of less than 0.1. In yet another preferred embodiment, the Fischer-Tropsch derived lubricant base oil fraction comprises a ratio of weight percent of molecules with monocycloparaffinic functionality to weight percent of molecules with multicycloparaffinic functionality of greater than 50. In another preferred embodiment, the Fischer-Tropsch derived lubricant base oil fraction comprises less than 0.10 weight percent aromatics and more preferably less than 0.05 weight percent aromatics.

The Fischer-Tropsch derived lubricant base oils fractions of the present invention are prepared from the waxy fractions of Fischer-Tropsch syncrude by a process including hydroisomerization. As such, the Fischer-Tropsch derived lubricant base oil fractions used in the blended lubricants are made by a process comprising performing a Fischer-Tropsch synthesis to provide a product stream; isolating from the product stream a substantially paraffinic wax feed; hydroisomerizing the substantially paraffinic wax feed; isolating an isomerized oil; and optionally hydrofinishing the isomerized oil. From the process, a Fischer-Tropsch derived lubricant base oil fraction comprising less than 0.30 weight percent aromatics, greater than 5 weight % molecules with cycloparaffinic functionality, and a ratio of weight percent of molecules with monocycloparaffinic functionality to weight percent of molecules with multicycloparaffinic functionality of greater than 15 is isolated. The above-recited preferred embodiments of the Fischer-Tropsch lubricating base oil also may be isolated from the process. Preferably, the substantially paraffinic wax feed is hydroisomerized using a shape selective intermediate pore size molecular sieve comprising a noble metal hydrogenation component under conditions of about 600° F. to 750° F. Preferred processes for making the Fischer-Tropsch lubricant base oils are described in U.S. Ser. No. 10/744,870, filed Dec. 23, 2003, herein incorporated by reference in its entirety. Examples of embodiments of Fischer-Tropsch lubricating base oil fractions with high monocycloparaffins and low multicycloparaffins are described in U.S. Ser. No. 10/744,389, filed Dec. 23, 2003, herein incorporated by reference in its entirety.

According to the present invention, it is desired that the blended lubricating base oils and the blended finished lubricants comprise Fischer-Tropsch lubricating base oils containing high weight percents of molecules with cycloparaffinic functionality because cycloparaffins impart additive solubility and elastomer compatibility. Lubricant blends and finished lubricants comprising Fischer-Tropsch lubricating base oils containing very high ratios of weight percent of molecules with monocycloparaffinic functionality to weight percent of molecules with multicycloparaffinic functionality (or high weight percent of molecules with monocycloparaffinic functionality and extremely low weight percent of molecules with multicycloparaffinic functionality) are also desirable because molecules with multicycloparaffinic functionality reduce oxidation stability, lower viscosity index, and increase Noack volatility. Models of the effects of molecules with multicycloparaffinic functionality are given in V. J. Gatto, et al, "The Influence of Chemical Structure on the Physical Properties and Antioxidant Response of Hydrocracked Base Stocks and Polyalphaolefins," J. Synthetic Lubrication 19-1, April 2002, pp 3-18.

Accordingly, in a preferred embodiment, the lubricant blends and finished lubricants according to the present invention comprise a Fischer-Tropsch lubricant base oil comprising very low weight percents of molecules with aromatic functionality, a high weight percent of molecules with cycloparaffinic functionality, and a high ratio of weight percent of molecules with monocycloparaffinic functionality to weight percent of molecules with multicycloparaffinic functionality (or high weight percent of molecules with monocycloparaffinic functionality and very low weight percents of molecules with multicycloparaffinic functionality).

The Fischer-Tropsch lubricant base oil fractions used in the lubricant blends and finished lubricants contain greater than 95 weight % saturates as determined by elution column chromatography, ASTM D 2549-02. Olefins are present in an amount less than detectable by long duration $C^{13}$ Nuclear Magnetic Resonance Spectroscopy (NMR). Preferably, molecules with aromatic functionality are present in amounts less than 0.3 weight percent by HPLC-UV, and confirmed by ASTM D 5292-99 modified to measure low level aromatics. In preferred embodiments molecules with at least aromatic functionality are present in amounts less than 0.10 weight percent, preferably less than 0.05 weight percent, more preferably less than 0.01 weight percent. Sulfur is present in amounts less than 25 ppm, more preferably less than 1 ppm as determined by ultraviolet fluorescence by ASTM D 5453-00.

The petroleum derived base oil fraction of the blended lubricant comprises greater than 90 weight % saturates and less than 300 ppm sulfur. Preferably, the petroleum derived base oil fraction is selected from the group consisting of a Group II base oil, a Group III base oil, and mixtures thereof. The petroleum derived base oil fraction can be a heavy neutral base oil, a medium neutral base oil, or a mixture thereof.

The lubricant blends of the present invention comprise from about 10 to 80 weight % Fischer-Tropsch derived lubricant base oil fraction, from about 20 to 90 weight % petroleum derived base oil, and from about 0.01 to 12 weight % pour point depressant. Preferably, the lubricant blends of the present invention comprise from about 20 to 80 weight % Fischer-Tropsch derived lubricant base oil fraction, from about 20 to 75 weight % petroleum derived base oil, and from about 0.05 to 10 weight % pour point depressant. The gear oils of the present invention comprise the lubricant blend and one additive in addition to the pour point depressant. As such, the gear oils comprise (a) from about 49 to about 99.9 weight % of the lubricant blend according to the present invention and (b) from about 0.1 to about 51 weight % at least one additive in addition to the pour point depressant.

Definitions

The following terms will be used throughout the specification and will have the following meanings unless otherwise indicated.

The term "derived from a Fischer-Tropsch process" or "Fischer-Tropsch derived," means that the product, fraction, or feed originates from or is produced at some stage by a Fischer-Tropsch process.

The term "derived from a petroleum" or "petroleum derived" means that the product, fraction, or feed originates from the vapor overhead streams from distilling petroleum crude and the residual fuels that are the non-vaporizable remaining portion. A source of the petroleum derived can be from a gas field condensate.

Aromatics means any hydrocarbonaceous compounds that contain at least one group of atoms that share an uninterrupted cloud of delocalized electrons, where the number of delocalized electrons in the group of atoms corresponds to a solution to the Huckel rule of 4n+2 (e.g., n=1 for 6 electrons, etc.). Representative examples include, but are not limited to, benzene, biphenyl, naphthalene, and the like.

Molecules with cycloparaffinic functionality mean any molecule that is, or contains as a substituent, a monocyclic or multicyclic saturated hydrocarbon group of three to six ring carbons, where one or two of C atoms are optionally replaced by a carbonyl group. The cycloparaffinic group may be optionally substituted with one, two, or three substituents, preferably alkyl, alkenyl, halo, hydroxyl, cyano, nitro, alkoxy, haloalkyl, alkenyl, and alkenoxy. Representative examples of the cycloparaffinic group include, but are not limited to, cyclopropyl, cyclohexyl, cyclopentyl, and the like.

Molecules with monocycloparaffinic functionality mean any molecule that is, or contains as a substituent, a monocyclic saturated hydrocarbon group of three to six ring carbons, where one or two of C atoms are optionally replaced by a carbonyl group. The cycloparaffinic group may be optionally substituted with one, two, or three substituents, preferably alkyl, alkenyl, halo, hydroxyl, cyano, nitro, alkoxy, haloalkyl, alkenyl, and alkenoxy. Representative examples of the cycloparaffinic group include, but are not limited to, cyclopropyl, cyclohexyl, cyclopentyl, and the like.

Molecules with multicycloparaffinic functionality mean any molecule that is, or contains as a substituent, a multicyclic saturated hydrocarbon group of three to six ring carbons, where one or two of C atoms are optionally replaced by a carbonyl group. The cycloparaffinic group may be optionally substituted with one, two, or three substituents, preferably alkyl, alkenyl, halo, hydroxyl, cyano, nitro, alkoxy, haloalkyl, alkenyl, and alkenoxy.

Brookfield Viscosity: ASTM D 2983-03 is used to determine the low-shear-rate viscosity of automotive fluid lubricants at low temperatures. The low-temperature, low-shear-rate viscosity of automatic transmission fluids, gear oils, torque and tractor fluids, and industrial and automotive hydraulic oils are frequently specified by Brookfield viscosities. The GM 2003 DEXRON® III automatic transmission fluid specification requires a maximum Brookfield viscosity at −40° C. of 20,000 cP. The Ford MERCON® V specification requires a Brookfield viscosity between 5,000 and 13,000 cP. The Automotive Gear Lubricant Vicosity Classification SAE J306 for 75W gear lubricants has a low temperature viscosity specification such tht the maximum temperature for a viscosity of 150,000 cP is −40° C. The lubricant blends of this invention will have a Brookfield viscosity at −40° C. of less than 100,000 cP, preferably less than 60,000 cP, preferably less than 50,000 cP, more preferably less than 35,000 cP, even more preferably less than 25,000 cP, and even more preferably less than 15,000 cP.

Automotive Gear Lubricant Viscosity Classifications - SAE J306

| SAE Viscosity | Max Temperature for Viscosity of | Kinematic Viscosity at 100° C. (cSt) | |
|---|---|---|---|
| Grade | 150,000 cP (° C.) | min | max |
| 70W | −55 | 4.1 | — |
| 75W | −40 | 4.1 | — |
| 80W | −26 | 7.0 | — |
| 85W | −12 | 11.0 | — |
| 80 | — | 7.0 | <11.0 |
| 85 | — | 11.0 | <13.5 |
| 90 | — | 13.5 | <24.0 |
| 140 | — | 24.0 | <41.0 |
| 250 | — | 41.0 | — |

The lubricant blends and finished gear oils comprising these lubricant blends exhibit desirable properties in addition to exception low Brookfield viscosities at −40° C., including good kinematic viscosity, low Noack volatility, and high oxidative stability, and low pour and cloud points.

Kinematic viscosity is a measurement of the resistance to flow of a fluid under gravity. Many lubricating base oils, finished lubricants made from them, and the correct operation of equipment depends upon the appropriate viscosity of the fluid being used. Kinematic viscosity is determined by ASTM D 445-01. The results are reported in centistokes (cSt). The lubricant blends of the present invention have a kinematic viscosity of about 3.0 cSt or greater at 100° C. In one embodiment, the lubricant blends have a kinematic viscosity of about 3.0 cSt or greater and less than about 5.0 cSt at 100 °C. In another embodiment, the lubricant blends have a kinematic viscosity of about 5.0 cSt or greater and less than about 7.0 cSt at 100° C.

The Fischer-Tropsch derived lubricant base oil fractions have a kinematic viscosity of between about 2.0 cSt and 20 cSt at 100° C. The Fischer-Tropsch derived lubricant base oil fractions may be of varying kinematic viscosities within this range at 100° C. Preferably, Fischer-Tropsch derived lubricant base oil fractions have a kinematic viscosity of between about 2.0 cSt and 12.0 cSt at 100° C. In one embodiment, the Fischer-Tropsch derived lubricant base oil fractions have a kinematic viscosity of between about 2.0 cSt and 3.0 cSt at 100° C. In another embodiment, the Fischer-Tropsch derived lubricant base oil fractions have a kinematic viscosity of between about 3.0 cSt and 6.0 cSt at 100° C.

Viscosity Index (VI) is an empirical, unitless number indicating the effect of temperature change on the kinematic viscosity of the oil. Liquids change viscosity with temperature, becoming less viscous when heated; the higher the VI of an oil, the lower its tendency to change viscosity with temperature. High VI lubricants are needed wherever relatively constant viscosity is required at widely varying temperatures. For example, in an automobile, engine oil must flow freely enough to permit cold starting, but must be viscous enough after warm-up to provide full lubrication. VI may be determined as described in ASTM D 2270-93. Preferably, the lubricant blends of the present invention have a viscosity index of greater than 120.

The "Viscosity Index Factor" of the Fischer-Tropsch derived lubricant base oil is an empirical number derived from kinematic viscosity of the Fischer-Tropsch derived lubricant base oil fraction. The viscosity index factor is calculated by the following equation:

$$\text{Viscosity Index Factor}=28\times\ln(\text{Kinematic Viscosity of Fischer-Trospch derived lubricant base oil fraction at 100° C.})+95$$

The Fischer-Tropsch derived lubricant base oil fractions may have a Viscosity Index greater than the Viscosity Index Factor.

Pour point is a measurement of the temperature at which a sample of lubricating base oil will begin to flow under carefully controlled conditions. Pour point may be determined as described in ASTM D 5950-02. The results are reported in degrees Celsius. Many commercial lubricating base oils have specifications for pour point. When lubricant base oils have low pour points, they also are likely to have other good low temperature properties, such as low cloud point, low cold filter plugging point, and low temperature cranking viscosity. Cloud point is a measurement complementary to the pour point, and is expressed as a temperature at which a sample of the lubricant base oil begins to develop a haze under carefully specified conditions. Cloud point may be determined by, for example, ASTM D 5773-95. Lubricating base oils having pour-cloud point spreads below about 35° C. are desirable. Higher pour-cloud point spreads require processing the lubricating base oil to very low pour points in order to meet cloud point specifications. The pour-cloud point spreads of the blended lubricating base oils and blended finished lubricants of this invention are generally less than about 35° C., preferably less than about 25° C., more preferably less than about 10° C.

Noack volatility is defined as the mass of oil, expressed in weight %, which is lost when the oil is heated at 250° C. and 20 mmHg (2.67 kPa; 26.7 mbar) below atmospheric in a test crucible through which a constant flow of air is drawn for 60 minutes, according to ASTM D5800. A more convenient method for calculating Noack volatility and one which correlates well with ASTM D5800 is by using a thermo gravimetric analyzer test (TGA) by ASTM D6375. TGA Noack volatility is used throughout this disclosure unless otherwise stated. Noack volatility of engine oil, as measured by TGA Noack and similar methods, has been found to correlate with oil consumption in passenger car engines. Strict requirements for low volatility are important aspects of several recent engine oil specifications, such as, for example, ACEA A-3 and B-3 in Europe and ILSAC GF-3 in North America. The Fischer-Tropsch derived lubricant base oil fractions of the present invention may have a Noack volatility of less than 50 weight %.

The "Noack Volatility Factor" of the Fischer-Tropsch derived lubricant base oil is an empirical number derived from kinematic viscosity of the Fischer-Tropsch derived lubricant base oil fraction. The noack volatility factor is calculated by the following equation:

$$\text{Noack Volatility Factor}=1000(\text{Kinematic Viscosity of the Fischer-Tropsch derived lubricant base oil fraction at } 100^\circ\text{ C.})^{-2.7}$$

Preferably, the Fischer-Tropsch derived lubricant base oil fractions have a Noack Volatility less than a Noack Volatility Factor as calculated by the following equation:

The Oxidator BN with L-4 Catalyst Test is a test measuring resistance to oxidation by means of a Dornte-type oxygen absorption apparatus (R. W. Dornte "Oxidation of White Oils," Industrial and Engineering Chemistry, Vol. 28, page 26, 1936). Normally, the conditions are one atmosphere of pure oxygen at 340° F., reporting the hours to absorption of 1000 ml of $O_2$ by 100 g of oil. In the Oxidator BN with L-4 Catalyst test, 0.8 ml of catalyst is used per 100 grams of oil. The catalyst is a mixture of soluble metal naphthenates in kerosene simulating the average metal analysis of used crankcase oil. The mixture of soluble metal naphthenates simulates the average metal analysis of used crankcase oil. The level of metals in the catalyst is as follows: Copper=6, 927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA® 260. The Oxidator BN with L-4 Catalyst Test measures the response of a finished lubricant in a simulated application. High values, or long times to adsorb one liter of oxygen, indicate good stability. OLOA® is an acronym for Oronite Lubricating Oil Additive®, which is a registered trademark of ChevronTexaco Oronite Company.

Generally, the Oxidator BN with L-4 Catalyst Test results should be above about 7 hours. Preferably, the Oxidator BN with L-4 value will be greater than about 10 hours. The Fischer-Tropsch derived lubricant base oil fractions of the lubricant blend of the present invention have results much greater than 10 hours. Preferably, the Fischer-Tropsch derived lubricant base oil fractions of the lubricant blends of the present invention have an Oxidator BN with L-4 Catalyst test result of greater than 25 hours.

Fischer-Tropsch Synthesis Process

The lubricant blends according to the present invention comprise a Fischer-Tropsch derived lubricant base oil fraction. The Fischer-Tropsch derived lubricant base oil fraction comprises less than 0.30 weight percent aromatics, greater than 5 weight % molecules with cycloparaffinic functionality, and a ratio of weight percent of molecules with monocycloparaffinic functionality to weight percent of molecules with multicycloparaffinic functionality of greater than 15. The Fischer-Tropsch derived lubricant base oil fraction has a viscosity of between about 2 cSt and 20 cSt at 100° C., preferably between about 2 cSt and 12 cSt at 100° C.

These Fischer-Tropsch derived lubricant base oil fractions are made by a Fischer-Tropsch synthesis process followed by hydroisomerization of the waxy fractions of the Fischer-Tropsch syncrude.

Fischer-Tropsch Synthesis

In Fischer-Tropsch chemistry, syngas is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. Generally, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason and depending on the quality of the syngas, it is preferred to remove sulfur and other contaminants from the feed before performing the Fischer-Tropsch chemistry. Means for removing these contaminants are well known to those of skill in the art. For example, ZnO guardbeds are preferred for removing sulfur impurities. Means for removing other contaminants are well known to those of skill in the art. It also may be desirable to purify the syngas prior to the Fischer-Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer-Tropsch process, contacting a synthesis gas comprising a mixture of $H_2$ and CO with a Fischer-Tropsch catalyst under suitable temperature and pressure reactive conditions forms liquid and gaseous hydrocarbons. The Fischer-Tropsch reaction is typically conducted at temperatures of about 300-700° F. (149-371° C.), preferably about 400-550° F. (204-228° C.); pressures of about 10-600 psia, (0.7-41 bars), preferably about 30-300 psia, (2-21 bars); and catalyst space velocities of about 100-10,000 cc/g/hr, preferably about 300-3,000 cc/g/hr. Examples of conditions for performing Fischer-Tropsch type reactions are well known to those of skill in the art.

The products of the Fischer-Tropsch synthesis process may range from $C_1$ to $C_{200+}$ with a majority in the $C_5$ to $C_{100+}$ range. The reaction can be conducted in a variety of reactor types, such as fixed bed reactors containing one or more catalyst beds, slurry reactors, fluidized bed reactors, or a combination of different type reactors. Such reaction processes and reactors are well known and documented in the literature.

The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP0609079, also completely incorporated herein by reference for all purposes.

In general, Fischer-Tropsch catalysts contain a Group VIII transition metal on a metal oxide support. The catalysts may also contain a noble metal promoter(s) and/or crystalline molecular sieves. Suitable Fischer-Tropsch catalysts comprise one or more of Fe, Ni, Co, Ru and Re, with cobalt being preferred. A preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Certain catalysts are known to provide chain growth probabilities that are relatively low to moderate, and the reaction products include a relatively high proportion of low molecular ($C_{2-8}$) weight olefins and a relatively low proportion of high molecular weight ($C_{30+}$) waxes. Certain other catalysts are known to provide relatively high chain growth probabilities, and the reaction products include a relatively low proportion of low molecular ($C_{2-8}$) weight olefins and a relatively high proportion of high molecular weight ($C_{30+}$) waxes. Such catalysts are well known to those of skill in the art and can be readily obtained and/or prepared.

The product from a Fischer-Tropsch process contains predominantly paraffins. The products from Fischer-Tropsch reactions generally include a light reaction product and a waxy reaction product. The light reaction product (i.e., the condensate fraction) includes hydrocarbons boiling below about 700° F. (e.g., tail gases through middle distillate fuels), largely in the $C_5$-$C_{20}$ range, with decreasing amounts up to about $C_{30}$. The waxy reaction product (i.e., the wax fraction) includes hydrocarbons boiling above about 600° F. (e.g., vacuum gas oil through heavy paraffins), largely in the $C_{20+}$ range, with decreasing amounts down to $C_{10}$. Both the light reaction product and the waxy product are substantially paraffinic. The waxy product generally comprises greater than 70 weight % normal paraffins, and often greater than 80 weight % normal paraffins. The light reaction product comprises paraffinic products with a significant proportion of alcohols and olefins. In some cases, the light reaction product may comprise as much as 50 weight %, and even higher, alcohols and olefins. It is the waxy reaction product (i.e., the wax fraction) that is used as a feedstock to the process for providing the Fischer-Tropsch derived lubricant base oil fraction used in the blended lubricants and blended finished lubricants of the present invention.

The Fischer-Tropsch lubricant base oil fractions used in the blended lubricants are prepared from the waxy fractions of the Fischer-Tropsch syncrude by a process including hydroisomerization. Preferably, the Fischer-Tropsch lubricant base oils are made by a process as described in U.S. Ser. No. 10/744,870, filed Dec. 23, 2003, herein incorporated by reference in its entirety. The Fischer-Tropsch lubricant base oil fractions used in the blended lubricants and blended finished lubricants of the present invention may be manufactured at a site different from the site at which the components of the blended lubricant are received and blended.

Hydroisomerization

Hydroisomerization is intended to improve the cold flow properties of the lubricating base oil by the selective addition of branching into the molecular structure. Hydroisomerization ideally will achieve high conversion levels of the Fischer-Tropsch wax to non-waxy iso-paraffins while at the same time minimizing the conversion by cracking. Preferably, the conditions for hydroisomerization in the present invention are controlled such that the conversion of the compounds boiling above about 700° F. in the wax feed to compounds boiling below about 700° F. is maintained between about 10 wt % and 50 wt %, preferably between 15 wt % and 45 wt %.

According to the present invention, hydroisomerization is conducted using a shape selective intermediate pore size molecular sieve. Hydroisomerization catalysts useful in the present invention comprise a shape selective intermediate pore size molecular sieve and optionally a catalytically active metal hydrogenation component on a refractory oxide support. The phrase "intermediate pore size," as used herein means an effective pore aperture in the range of from about 3.9 to about 7.1 Å when the porous inorganic oxide is in the calcined form. The shape selective intermediate pore size molecular sieves used in the practice of the present invention are generally 1-D 10-, 11- or 12-ring molecular sieves. The preferred molecular sieves of the invention are of the 1-D 10-ring variety, where 10- (or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings may also be encompassed within the definition of the molecular sieve of the present invention. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Angstrom, having a maximum crystallographic free diameter of not more than 7.1 and a minimum crystallographic free diameter of not less than 3.9 Angstrom. Preferably the maximum crystallographic free diameter is not more than 7.1 and the minimum crystallographic free diameter is not less than 4.0 Angstrom. Most preferably the maximum crystallographic free diameter is not more than 6.5 and the minimum crystallographic free diameter is not less than 4.0 Angstrom. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15, which is incorporated herein by reference.

A particularly preferred intermediate pore size molecular sieve, which is useful in the present process is described, for example, in U.S. Pat. Nos. 5,135,638 and 5,282,958, the contents of which are hereby incorporated by reference in their entirety. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1 Å. The catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40 percent or greater (isomerization selectivity is determined as follows: 100×(weight % branched $C_{16}$ in product)/(weight % branched $C_{16}$ in product+weight % $C_{13-}$ in product) when used under conditions leading to 96% conversion of normal hexadecane (n-$C_{16}$) to other species.

Such a particularly preferred molecular sieve may further be characterized by pores or channels having a crystallographic free diameter in the range of from about 4.0 to about 7.1 Å, and preferably in the range of 4.0 to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes ($p/p_o$=0.5 at 25° C.). Intermediate pore size molecular sieves will typically admit molecules having kinetic diameters of 5.3 to 6.5 Angstrom with little hindrance.

Hydroisomerization catalysts useful in the present invention comprise a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 to 5 weight percent of the total catalyst, usually from 0.1 to 2 weight percent, and not to exceed 10 weight percent.

The refractory oxide support may be selected from those oxide supports, which are conventionally used for catalysts, including silica, alumina, silica-alumina, magnesia, titania and combinations thereof.

The conditions for hydroisomerization will be tailored to achieve a Fischer-Tropsch derived lubricant base oil fraction comprising less than about 0.3 weight % aromatics, greater than 5 weight % molecules with cycloparaffinic functionality, and a ratio of weight percent of molecules with moncycloparaffinic functionality of weight percent of molecules with multicycloparaffnic functionality of greater than 15. The conditions for hydroisomerization will depend on the properties of feed used, the catalyst used, whether or not the catalyst is sulfided, the desired yield, and the desired properties of the lubricant base oil. Conditions under which the hydroisomerization process of the current invention may be carried out include temperatures from about 500° F. to about 775° F. (260° C. to about 413° C.), preferably 600° F. to about 750° F. (315° C. to about 399° C.), more preferably about 600° F. to about 700° F. (315° C. to about 371° C.); and pressures from about 15 to 3000 psig, preferably 100 to 2500 psig. The hydroisomerization pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to 20 hr-1, preferably from about 0.1 to about 5 hr-1. The hydrogen to hydrocarbon ratio falls within a range from about 1.0 to about 50 moles $H_2$ per mole hydrocarbon, more preferably from about 10 to about 20 moles $H_2$ per mole hydrocarbon. Suitable conditions for performing hydroisomerization are described in U.S. Pat. Nos. 5,282,958 and 5,135,638, the contents of which are incorporated by reference in their entirety.

Hydrogen is present in the reaction zone during the hydroisomerization process, typically in a hydrogen to feed ratio from about 0.5 to 30 MSCF/bbl (thousand standard cubic feet per barrel), preferably from about 1 to about 10 MSCF/bbl. Hydrogen may be separated from the product and recycled to the reaction zone.

Hydrotreating

Waxy feed to the hydroisomerization process may be hydrotreated prior to hydroisomerization. Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated.

Catalysts used in carrying out hydrotreating operations are well known in the art. See, for example, U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

Typical hydrotreating conditions vary over a wide range. In general, the overall LHSV is about 0.25 to 2.0, preferably about 0.5 to 1.5. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300° F. to about 750° F. (about 150° C. to about 400° C.), preferably ranging from 450° F. to 725° F. (230° C. to 385° C.).

Hydrofinishing

Hydrofinishing is a hydrotreating process that may be used as a step following hydroisomerization to provide the Fischer-Tropsch lubricating base oil. Hydrofinishing is intended to improve oxidation stability, UV stability, and appearance of the Fischer-Tropsch lubricating base oil product by removing traces of aromatics, olefins, color bodies, and solvents. As used in this disclosure, the term UV stability refers to the stability of the lubricating base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487.

The Fischer-Tropsch lubricating base oils of the present invention may be hydrofinished to improve product quality and stability. During hydrofinishing, overall liquid hourly space velocity (LHSV) is about 0.25 to 2.0 $hr^{-1}$, preferably about 0.5 to 1.0 $hr^{-1}$. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

Suitable hydrofinishing catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble metal (such as nickel-molybdenum and/or tungsten, and at least about 0.5, and generally about 1 to about 15 weight percent of nickel and/or cobalt determined as the corresponding oxides. The noble metal (such as platinum) catalyst contains in excess of 0.01 percent metal, preferably between 0.1 and 1.0 percent metal. Combinations of noble metals may also be used, such as mixtures of platinum and palladium.

Clay treating to remove impurities is an alternative final process step to provide Fischer-Tropsch derived lubricant base oil fractions.

Fractionation

Optionally, the process to provide the Fischer-Tropsch lubricating base oil may include fractionating the substantially paraffinic wax feed prior to hydroisomerization, or fractionating of the lubricating base oil obtained from the hydroisomerization process. The fractionation of the Fischer-Tropsch substantially paraffinic wax feed or the isomerized lubricant base oil into fractions is generally accomplished by either atmospheric or vacuum distillation, or by a combination of atmospheric and vacuum distillation. Atmospheric distillation is typically used to separate the lighter distillate fractions, such as naphtha and middle distillates, from a bottoms fraction having an initial boiling point above about 600° F. to about 750° F. (about 315° C. to about 399° C.). At higher temperatures thermal cracking of the hydrocarbons may take place leading to fouling of the equipment and to lower yields of the heavier cuts. Vacuum distillation is typically used to separate the higher boiling material, such as the lubricating base oil fractions, into different boiling range cuts. Fractionating the lubricating base oil into different boiling range cuts enables the lubricating base oil manufacturing plant to produce more than one grade, or viscosity, of lubricating base oil.

Solvent Dewaxing

The process to make the Fischer-Tropsch derived lubricating base oil may also include a solvent dewaxing step following the hydroisomerization process. Solvent dewaxing optionally may be used to remove small amounts of remaining waxy molecules from the lubricating base oil after hydroisomerization. Solvent dewaxing is done by dissolving the lubricating base oil in a solvent, such as methyl ethyl ketone, methyl iso-butyl ketone, or toluene, or precipitating the wax molecules as discussed in Chemical Technology of Petroleum, 3rd Edition, William Gruse and Donald Stevens, McGraw-Hill Book Company, Inc., New York, 1960, pages 566 to 570. Solvent dewaxing is also described in U.S. Pat. Nos. 4,477,333, 3,773,650 and 3,775,288.

Fischer-Tropsch Derived Lubricant Base Oil Fraction

The lubricant blends according to the present invention comprise a Fischer-Tropsch derived lubricant base oil fraction synthesized as described herein. The Fischer-Tropsch derived lubricant base oil fraction has a viscosity of between about 2 cSt and 20 cSt at 100° C., preferably between about 2 cSt and 12 cSt at 100° C. The Fischer-Tropsch derived lubricant base oil fractions may be of varying kinematic viscosities. In one embodiment, the Fischer-Tropsch derived lubricant base oil fraction has a viscosity of between about 2 cSt and 3 cSt at 100° C. In another embodiment, the Fischer-Tropsch derived base oil fraction has a viscosity of between about 2 cSt and 20 cSt at 100° C.

Preferably, the Viscosity Index of the Fischer-Tropsch derived base oil fraction is greater than the Viscosity Index Factor as calculated by the following equation:

$$\text{Viscosity Index Factor}=28\times\ln(\text{Kinematic Viscosity of the Fischer-Tropsch derived base oil fraction at } 100^\circ\text{ C.})+95.$$

Despite the relatively low kinematic viscosity of some of the Fischer-Tropsch derived lubricant base oil fraction, the Noack volatility of the Fischer-Tropsch lubricant base oil fraction is much lower than that of a petroleum derived conventional Group I and Group II base oil of similar kinematic viscosity. Preferably, the Noack volatility of the Fischer-Tropsch derived lubricant base oil fraction is less than the Noack Volatility Factor as calculated by the following equation:

$$\text{Noack Volatility Factor}=1000(\text{Kinematic Viscosity of the Fischer-Tropsch derived lubricant base oil fraction at } 100^\circ\text{ C.})^{-2.7}$$

Preferably, the Fischer-Tropsch derived lubricant base oil fraction has a Noack volatility of less than 50 weight percent.

The Fischer-Tropsch derived lubricant base oil fraction comprise extremely low levels of unsaturates. The Fischer-Tropsch derived lubricant base oil fraction comprises less than 0.30 weight percent aromatics, greater than 5 weight % molecules with cycloparaffinic functionality, and a ratio of weight percent of molecules with monocycloparaffinic functionality to weight percent of molecules with multicycloparaffinic functionality of greater than 15.

In a preferred embodiment, the Fischer-Tropsch derived lubricant base oil fraction comprises greater than 10 weight percent molecules with cycloparaffinic functionality. In another preferred embodiment, the Fischer-Tropsch derived lubricant base oil fraction comprises less than 0.30 weight percent aromatics, a weight percent of molecules with monocycloparaffinic functionality of greater than 10, and a weight percent of molecules with multicycloparaffinic functionality of less than 0.1. In yet another preferred embodiment, the Fischer-Tropsch derived lubricant base oil fraction comprises a ratio of weight percent of molecules with monocycloparaffinic functionality to weight percent of molecules with multicycloparaffinic functionality of greater than 50. In another preferred embodiment, the Fischer-Tropsch derived lubricant base oil fraction comprises less than 0.10 weight percent aromatics and more preferably less than 0.05 weight percent aromatics.

The Fischer-Tropsch lubricant base oils used in the lubricant blends and finished lubricants contain greater than 95 weight % saturates as determined by elution column chromatography, ASTM D 2549-02. Olefins are present in an amount less than detectable by long duration $C^{13}$ Nuclear Magnetic Resonance Spectroscopy (NMR). Preferably, molecules with aromatic functionality are present in amounts less than 0.3 weight percent by HPLC-UV, and confirmed by ASTM D 5292-99 modified to measure low level aromatics. In preferred embodiments molecules with at least aromatic functionality are present in amounts less than 0.10 weight percent, preferably less than 0.05 weight percent, more preferably less than 0.01 weight percent. Sulfur is present in amounts less than 25 ppm, more preferably less than 1 ppm as determined by ultraviolet fluorescence by ASTM D 5453-00.

Aromatics Measurement by HPLC-UV:

The method used to measure low levels of molecules with aromatic functionality in the Fischer-Tropsch lubricating base oils uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated Fischer-Tropsch lubricating base oils was made on the basis of their UV spectral pattern and their elution time. The amino column used for this analysis differentiates aromatic molecules largely on the basis of their ring-number (or more correctly, double-bond number). Thus, the single ring aromatic containing molecules would elute first, followed by the polycyclic aromatics in order of increasing double bond number per molecule. For aromatics with similar double bond character, those with only alkyl substitution on the ring would elute sooner than those with cycloparaffinic substitution.

Unequivocal identification of the various base oil aromatic hydrocarbons from their UV absorbance spectra was somewhat complicated by the fact their peak electronic transitions were all red-shifted relative to the pure model compound analogs to a degree dependent on the amount of alkyl and cycloparaffinic substitution on the ring system. These bathochromic shifts are well known to be caused by alkyl-group delocalization of the π-electrons in the aromatic ring. Since few unsubstituted aromatic compounds boil in the lubricant range, some degree of red-shift was expected and observed for all of the principle aromatic groups identified.

Quantification of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricating base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-cycloalkyl-1-ring aromatics and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-cycloalkyl-1-ring aromatics in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricating base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricating base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of molecules with aromatic functionality in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricating base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Cycloparaffin Distribution by FIMS:

Paraffins are considered more stable than cycloparaffins towards oxidation, and therefore, more desirable. Monocycloparaffins are considered more stable than multicycloparaffins towards oxidation. However, when the weight percent of all molecules with at least one cycloparaffinic function is very low in a lubricating base oil, the additive solubility is low and the elastomer compatibility is poor. Examples of base oils with these properties are polyalphaolefins and Fischer-Tropsch base oils (GTL base oils) with less than about 5% cycloparaffins. To improve these properties in finished lubricants, expensive co-solvents such as esters must often be added. Preferably, the Fischer-Tropsch lubricating base oils used in the blended lubricants and blended finished lubricants of the present invention comprise a high weight percent of molecules with monocycloparaffinic functionality and a low weight percent of molecules with multicycloparaffinic functionality such that the Fischer-Tropsch lubricating base oils, and thus the blended lubricants and blended finished lubricants, have high oxidation stability and high viscosity index in addition to good additive solubility and elastomer compatibility.

The distribution of the saturates (n-paraffin, iso-paraffin, and cycloparaffins) in the Fischer-Tropsch lubricating base oils is determined by field ionization mass spectroscopy (FIMS). FIMS spectra were obtained on a VG 70VSE mass spectrometer. The samples were introduced via a solid probe, which was heated from about 40° C. to 500° C. at a rate of 50° C. per minute. The mass spectrometer was scanned from m/z 40 to m/z 1000 at a rate of 5 seconds per decade. The acquired mass spectra were summed to generate one "averaged" spectrum. Each spectrum was $C_{13}$ corrected using a software package from PC-MassSpec. FIMS ionization efficiency was evaluated using blends of nearly pure branched paraffins and highly cycloparaffinic, aromatics-free base stock. The ionization efficiencies of iso-paraffins and cycloparaffins in these base oils were essentially the same. Iso-paraffins and cycloparaffins comprise more than 99.9% of the saturates in the Fischer-Tropsch lubricating base oils.

The Fischer-Tropsch lubricating base oils are characterized by FIMS into paraffins and cycloparaffins containing different numbers of rings. Monocycloparaffins contain one ring, dicycloparaffins contain two rings, tricycloparaffins contain three rings, tetracycloparaffins contain four rings, pentacycloparaffins contain five rings, and hexacycloparaffins contain six rings. Cycloparaffins with more than one ring are referred to as multicycloparaffins in this invention.

In one embodiment, the Fischer-Tropsch lubricating base oils have a weight percent of molecules with cycloparaffinic functionality greater than 10, preferably greater than 15, more preferably greater than 20. They have a ratio of weight percent of molecules with monocycloparaffinic functionality to weight percent of molecules with multicycloparaffinic functionality greater than 15, preferably greater than 50, more preferably greater than 100. In preferred embodiments, the Fischer-Tropsch lubricating base oils have a weight percent of molecules with monocycloparaffinic functionality greater than 10, and a weight percent of molecules with multicycloparaffinic functionality less than 0.1, or even no molecules with multicycloparaffinic functionality. In this embodiment, the Fischer-Tropsch lubricating base oils may have a kinematic viscosity at 100° C. between about 2 cSt and about 20 cSt, preferably between about 2 cSt and about 12 cSt.

In another embodiment of the Fischer-Tropsch lubricating base oils, there is a relationship between the weight percent of all molecules with at least one cycloparaffinic functionality and the kinematic viscosity of the lubricating base oils of this invention. That is, the higher the kinematic viscosity at 100° C. in cSt, the higher the amount of molecules with cycloparaffinic functionality that are obtained. In a preferred embodiment, the Fischer-Tropsch lubricating base oils have a weight percent of molecules with cycloparaffinic functionality greater than the kinematic viscosity in cSt multiplied by three, preferably greater than 15, more preferably greater than 20; and a ratio of weight percent of molecules with monocycloparaffinic functionality to weight percent of molecules with multicycloparaffinic functionality greater than 15, preferably greater than 50, more preferably greater than 100. The Fischer-Tropsch lubricating base oils have a kinematic viscosity at 100° C. between about 2 cSt and about 20 cSt, preferably between about 2 cSt and about 12 cSt. Examples of these base oils may have a kinematic viscosity at 100° C. of between about 2 cSt and about 3.3 cSt and have a weight percent of molecules with cycloparaffinic functionality that is high, but less than 10 weight percent.

The modified ASTM D 5292-99 and HPLC-UV test methods used to measure low level aromatics, and the FIMS test method used to characterize saturates are described in D. C. Kramer, et al., "Influence of Group II & III Base Oil Composition on VI and Oxidation Stability," presented at the 1999 AIChE Spring National Meeting in Houston, Mar. 16, 1999, the contents of which is incorporated herein in its entirety.

Although the Fischer-Tropsch wax feeds are essentially free of olefins, base oil processing techniques can introduce olefins, especially at high temperatures, due to 'cracking' reactions. In the presence of heat or UV light, olefins can polymerize to form higher molecular weight products that can color the base oil or cause sediment. In general, olefins can be removed during the process of this invention by hydrofinishing or by clay treatment.

The properties of the Fischer-Tropsch lubricant base oils used in the examples are summarized in Table II in the Examples.

Of the different saturated hydrocarbons found in lubricant base oils, traditionally paraffins have been considered more stable than cycloparaffins (naphthenes) toward oxidation, and therefore, more desirable. However, when the amount of aromatics in the base oil is less than 1 weight %, the most effective way to further improve oxidation stability is to increase the viscosity index of the base oil. Fischer-Tropsch lubricant base oils typically contain less than 1% aromatics. Due to their extremely low amount of aromatics and multi-ring cycloparaffins in the Fischer-Tropsch lubricant base oils of the present invention, their high oxidation stability far exceeds that of conventional lubricating base oils. Additionally, Fischer-Tropsch lubricant base oils are generally classified as API Group III base oils and have a low sulfur content of less than 5 ppm, a saturates content of greater than 95%, a high viscosity index of greater than 120, and excellent cold flow properties.

Petroleum Derived Base Oil Fraction

The lubricant blends according to the present invention also comprise a petroleum derived base oil fraction. The petroleum derived base oil fraction used in the blended lubricants of the present invention comprises greater than 90 weight % saturates and less than 300 ppm sulfur. Petroleum derived base oils are often referred to as neutral oils. In general, neutral oils are classified as heavy, medium, and light. Heavy neutral base oil has a normal boiling range of from about 900° F. to about 1000° F., a pour point not greater than about −7° C., and a kinematic viscosity at 100° C. of about 8 cSt to about 20 cSt. Medium neutral base oil has a normal boiling range of from about 800° F. to about 900° F., a pour point intermediate of heavy and light neutral oil, and a kinematic viscosity at 100° C. of from about 5 cSt to about 8 cSt. Light neutral base oil has a normal boiling range of from about 700° F. to about 800° F., a pour point not greater than about −15° C., and a kinematic viscosity at 100° C. of about 4 cSt to about 5 cSt. The petroleum derived base oil fraction used in the blended lubricants of the present invention can a heavy neutral base oil, a medium neutral base oil, or a mixture thereof.

Preferably, the petroleum derived base oil fraction is selected from the group consisting of a Group II base oil, a Group III base oil, and mixtures thereof. According to the present invention, it has been surprisingly discovered that lubricant blends with petroleum derived Group II base oils have substantially lower Brookfield viscosities than blends with Group I base oils. It is expected that lubricant blends with petroleum derived Group III base oils also exhibit substantially lower Brookfield viscosities than blends with Group I base oils.

The specifications for lubricant base oils are defined in the API Interchange Guidelines (API Publication 1509) using sulfur content, saturates content, and viscosity index, as follows:

| Group | Sulfur, ppm | And/or | Saturates, % | Viscosity Index (V.I.) |
|---|---|---|---|---|
| I | >300 | And/or | <90 | 80-120 |
| II | <300 | And | >90 | 80-120 |
| III | <300 | And | >90 | >120 |
| IV | All Polyalphaolefins (PAOs) | | | |
| V | All Stocks Not Included in Groups I-IV | | | |

Plants that make Group I base oils typically use solvents to extract the lower viscosity index (VI) components and increase the VI of the crude to the specifications desired. These solvents are typically phenol or furfural. Solvent extraction gives a product with less than 90% saturates and more than 300 ppm sulfur. The majority of the lubricant production in the world is in the Group I category.

Plants that make Group II base oils typically employ hydroprocessing such as hydrocracking or severe hydrotreating to increase the VI of the crude oil to the specification value. The use of hydroprocessing typically increases the saturates content above 90 and reduces the sulfur below 300 ppm. Approximately 10% of the lubricant base oil production in the world is in the Group II category, and about 30% of U.S. production is Group II.

Plants that make Group III base oils typically employ wax isomerization technology to make very high VI products. Since the starting feed is waxy vacuum gas oil (VGO) or wax which contains all saturates and little sulfur, the Group III products have saturate contents above 90 and sulfur contents below 300 ppm. Fischer-Tropsch wax is an ideal feed for a wax isomerization process to make Group III lubricant oils. Only a small fraction of the world's lubricant supply is in the Group III category.

Group IV lubricant base oils are derived by oligomerization of normal alpha olefins and are called poly alpha olefin (PAO) lubricant base oils. Group V lubricant base oils are all others. This group includes synthetic esters, silicon lubricants, halogenated lubricant base oils and lubricant base oils with VI values below 80. The latter can be described as petroleum-derived Group V lubricant base oils. Petroleum-derived Group V lubricant base oils typically are prepared by the same processes used to make Group I and II lubricant base oils, but under less severe conditions.

Preferably, the petroleum derived base oil fraction is selected from the group consisting of a Group II base oil, a Group III base oil, and mixtures thereof.

Pour Point Depressant

The lubricant blends of the present invention further comprise at least one pour point depressant. Pour point depressants are known in the art and include, but are not limited to esters of maleic anhydride-styrene copolymers, polymethacrylates, polyacrylates, polyacrylamides, condensation products of haloparaffin waxes and aromatic compounds, vinyl carboxylate polymers, and terpolymers of dialkylfumarates, vinyl esters of fatty acids, ethylene-vinyl acetate copolymers, alkyl phenol formaldehyde condensation resins, alkyl vinyl ethers, olefin copolymers, and mixtures thereof. Preferably, the pour point depressant is polymethacrylate.

The pour point depressant utilized in the present invention may also be a pour point depressing base oil blending component prepared from an isomerized Fischer-Tropsch derived bottoms product, as described in U.S. patent application Ser. No. 10/704,031, filed on Nov. 7, 2003, the contents of which are herein incorporated by reference in its entirety. When used, the pour point depressing base oil blending component reduces the pour point of the lubricant blend at least 3° C. below the pour point of the lubricant base oil blend in the absence of the pour point depressing base oil blending component. The pour point depressing base oil blending component is an isomerized Fischer-Tropsch derived bottoms product having a pour point that is at least 3° C. higher than the pour point of the lubricant base oil comprising the Fischer-Tropsch derived lubricant base oil fraction and the petroleum derived base oil (i.e., the blend in the absence of a pour point depressant). For example, if the target pour point of the blended lubricant is −9° C. and the pour point of the blended lubricant in the absence of pour point depressant is greater than −9° C., an amount of the pour point depressing base oil blending component of the invention will be blended with the blended lubricant in sufficient proportion to lower the pour point of the blend to the target value.

The isomerized Fischer-Tropsch derived bottoms product used to lower the pour point of the lubricating base oil is usually recovered as the bottoms from the vacuum column of a Fischer-Tropsch operation. The average molecular weight of the pour point depressing base oil blending component usually will fall within the range of from about 600 to about 1100 with an average molecular weight between about 700 and about 1000 being preferred. Typically the pour point of the pour point depressing base oil blending component will be between about −9° C. and about 20° C. The 10 percent point of the boiling range of the pour point depressing base oil blending component usually will be within the range of from about 850° F. and about 1050° F. Preferably, the pour point depressing base oil blending component will have an average degree of branching in the molecules between about 6.5 and about 10 alkyl branches per 100 carbon atoms.

In one embodiment the lubricant blend may comprise a pour point depressant well known in the art and an isomerized Fischer-Tropsch derived bottoms product. In such an embodiment, preferably, the lubricant blend comprises 0.05 to 15 weight % isomerized Fischer-Tropsch derived bottoms product.

Lubricant Blends

The lubricant blends of the present invention comprise the Fischer-Tropsch derived lubricant base oil fraction, the petroleum derived base oil, and the pour point depressant. The lubricant blend preferably comprises the Fischer-Tropsch derived lubricant base oil fraction in an amount of about 10 to 80 weight %, the petroleum derived base oil in an amount of about 20 to 90 weight %, and the pour point depressant in an amount of about 0.01 to 12 weight % based on the total lubricant blend.

The lubricant blends exhibit a surprising low Brookfield viscosities. The lubricant blends exhibit Brookfield viscosities at −40° C. of less than 100,000 cP. Preferably, the lubricant blends of this invention will have a Brookfield viscosity at −40° C. of less than 90,000 cP, more preferably less than 60,000 cP, more preferably less than 50,000 cP, more preferably less than 35,000 cP, even more preferably less than 25,000 cP, and even more preferably less than 15,000 cP.

The lubricant blends and finished gear oils comprising these lubricant blends exhibit desirable properties in addition to exceptionally low Brookfield viscosities at −40° C., including good kinematic viscosity, low Noack volatility, and high oxidative stability, and low pour and cloud points. Thus, the blended lubricants of the present invention can be used to make high quality gear oils.

These lubricant blends have a viscosity of about 3 cSt or greater at 100° C. and have good low temperature properties. Preferably, the lubricant blends have a viscosity index of greater than 120. In one embodiment, the lubricant blends have a kinematic viscosity of about 3.0 cSt or greater and less than about 5.0 cSt at 100° C. In another embodiment, the lubricant blends have a kinematic viscosity of about 5.0 cSt or greater and less than about 7.0 cSt at 100° C.

The lubricant blend comprises a Fischer-Tropsch derived lubricant base oil fraction having a kinematic viscosity of between about 2 cSt and about 20 cSt at 100° C. The Fischer-Tropsch derived lubricant base oil fraction may be of varying kinematic viscosities within this range and the Brookfield viscosity of the lubricant blend may vary in accordance with the kinematic viscosity of the Fischer-Tropsch derived lubricant base oil fraction. In one embodiment, the lubricant blend comprises a Fischer-Tropsch derived lubricant base oil fraction having a kinematic viscosity of between about 2 cSt and 3 cSt at 100° C. In this embodiment, preferably the lubricant blend has a Brookfield viscosity at −40° C. of less than 35,000 cP. In another embodiment, the lubricant blend comprises a Fischer-Tropsch derived lubricant base oil fraction having a kinematic viscosity of between about 3 cSt and 6 cSt at 100° C. In this embodiment, preferably the lubricant blend has a Brookfield viscosity at −40° C. of less than 60,000 cP. In yet another embodiment, the lubricant blend comprises a Fischer-Tropsch derived lubricant base oil fraction having a kinematic viscosity of between about 2 cSt and 12 cSt at 100° C. In this embodiment, preferably the lubricant blend has a Brookfield viscosity at −40° C. of less than 90,000 cP.

The lubricant blend may be made by blending the Fischer-Tropsch derived lubricant base oil fraction, the petroleum derived base oil, and the pour point depressant by techniques known to those of skill in the art. The lubricant blend components may be blended in a single step going from the individual components (i.e., the Fischer-Tropsch lubricant base oil fraction, the petroleum derived base oil, and the pour point depressant) directly to provide the lubricant blend. In the alternative, the Fischer-Tropsch lubricant base oil fraction and the petroleum derived lubricant base oil may be blended initially and then the resulting blend may be mixed with the pour point depressant. The blend of the Fischer-Tropsch lubricant base oil fraction and the petroleum derived lubricant base oil may be isolated as such or the addition of the pour point depressant may occur immediately.

Gear Oils

To provide finished lubricants (i.e., gear oils), the lubricant blend according to the present invention is mixed with at least one additive in addition to the pour point depressant. When the blended lubricants of the present invention are blended with at least one additive in addition to the pour point depressant to provide a gear oil, the gear oil also exhibits exceptional low temperature properties, including low Brookfield viscosities at −40° C.

The additive in addition to the pour point depressant may be selected from the group consisting of antiwear additives, EP agents, detergents, dispersants, antioxidants, viscosity index improvers, ester co-solvents, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, thickeners, and combinations thereof.

When viscosity index improvers are added, preferably they are present in an amount less than 8 weight percent, and when ester co-solvents are added, preferably they are present in an amount less than 3 weight percent.

To formulate gear oils with high kinematic viscosities, such as ISO 68 and higher, a thickener additive may be utilized. ISO Viscosity Grades for Industrial Fluid Lubricants are as follows:

ISO Viscosity Grades for Industrial Fluid Lubricants

| ISO Viscosity Grade | Viscosity Grade Ranges (cSt at 40° C.) | |
|---|---|---|
| Numbers | Minimum | Maximum |
| 2 | 1.98 | 2.42 |
| 3 | 2.88 | 3.52 |
| 5 | 4.14 | 5.06 |
| 7 | 6.12 | 7.48 |
| 10 | 9.00 | 11.0 |
| 15 | 13.5 | 16.5 |
| 22 | 19.8 | 24.2 |
| 32 | 28.8 | 35.2 |
| 46 | 41.4 | 50.6 |
| 68 | 61.2 | 74.8 |
| 100 | 90.0 | 110 |
| 150 | 135 | 165 |
| 220 | 198 | 242 |
| 320 | 288 | 352 |
| 460 | 414 | 506 |
| 680 | 612 | 748 |
| 1000 | 900 | 1100 |
| 1500 | 1350 | 1650 |

Examples of thickness include polyisobutylene, high molecular weigh complex esters, butyl rubber, olefin copolymers, styrene-diene polymer, polymethacrylate, styrene-ester, and ultra high viscosity polyalpha olefins.

The gear oils may be made by blending the lubricant blend according to the present invention with at least one additive in addition to the pour point depressant by techniques known to those of skill in the art. The gear oils may be blended in a single step going from the individual components (i.e. the Fischer-Tropsch lubricant base oil fraction, the petroleum derived base oil, and the pour point depressant) directly to provide the gear oil. In the alternative, the Fischer-Tropsch lubricant base oil fraction, the petroleum derived base oil, and the pour point depressant may be blended initially to provide the lubricant blend and then the lubricant blend may be mixed with an additive in addition to the pour point depressant. The lubricant blend may be isolated as such or the addition of the additional additive may occur immediately.

The components of the lubricant blend may be manufactured at a site different from the site at which the components of the lubricant blend are received and blended. In addition, the gear oil may be manufactured at a site different from the site at which the components of the lubricant blend are received and blended. Preferably, the lubricant blend and the gear oil are made at the same site, which site is different from the site at which the components of the lubricant blend are originally made. Furthermore, the components of the lubricant blend (i.e., the Fischer-Tropsch lubricant base oil fraction, the petroleum derived base oil, and the pour point depressant) may be manufactured at different sites. Preferably, the Fischer-Tropsch lubricant base oil fraction is manufactured at a remote site (i.e., a location away from a refinery or market that may have a higher cost of construction than the cost of construction at the refinery or market. In quantitative terms, the distance of transportation between the remote site and the refinery or market is at least 100 miles, preferably more than 500 miles, and most preferably more than 1000 miles).

Preferably, the Fischer-Tropsch lubricant base oil is manufactured as a first remote site and shipped to a second site. The petroleum derived base oil may be manufactured at a site that is the same as the first remote site or at a third remote site. The second site receives the Fischer-Tropsch lubricant base oil, the petroleum derived base oil, and the additives including the pour point depressant, and the lubricant blend is manufactured at this second site. Preferably, the gear oil is also made at this second site.

EXAMPLES

The invention will be further explained by the following illustrative examples that are intended to be non-limiting.

Oxidation stability was determined using the Oxidator BN with L-4 Catalyst Test. The Oxidator BN with L-4 Catalyst Test is a test measuring resistance to oxidation by means of a Dornte-type oxygen absorption apparatus (R. W. Dornte "Oxidation of White Oils," Industrial and Engineering Chemistry, Vol. 28, page 26, 1936). Normally, the conditions are one atmosphere of pure oxygen at 340° F., reporting the hours to absorption of 1000 ml of $O_2$ by 100 g of oil. In the Oxidator BN with L-4 Catalyst test, 0.8 ml of catalyst is used per 100 grams of oil. The catalyst is a mixture of soluble metal naphthenates simulating the average metal analysis of used crankcase oil. The Oxidator Bn with L-4 Catalyst Test measures the response of a finished lubricant in a simulated application. High values, or long times to adsorb one liter of oxygen, indicate good stability.

Example 1

Fischer-Tropsch Wax and Preparation of Fischer-Tropsch Lubricating Base Oils Two samples of hydrotreated Fischer-Tropsch wax, FT Wax A and FT Wax B, were made using a Co-based Fischer-Tropsch catalyst. Both samples were analyzed and found to have the properties shown in Table I.

TABLE I

Fischer-Tropsch Wax

| Fischer-Tropsch Catalyst | Co-Based | Co-Based |
|---|---|---|
| Fischer-Tropsch Wax | FT Wax A | FT Wax B |
| Sulfur, ppm | <6 | 7, <2* |
| Nitrogen, ppm | 6, 5 | 12, 19 |
| Oxygen by Neutron Activation, Wt % | 0.59 | 0.69 |
| Oil Content, D 721, Wt % | 5.98 | 6.68 |
| GC N-Paraffin Analysis | | |
| Total N Paraffin, Wt % | 84.47 | 83.72 |
| Avg. Carbon Number | 27.3 | 30.7 |
| Avg. Molecular Weight | 384.9 | 432.5 |
| D-6352 SIMDIST TBP (WT %), ° F. | | |
| $T_{0.5}$ | 515 | 129 |
| $T_5$ | 597 | 568 |
| $T_{10}$ | 639 | 625 |
| $T_{20}$ | 689 | 674 |
| $T_{30}$ | 714 | 717 |
| $T_{40}$ | 751 | 756 |
| $T_{50}$ | 774 | 792 |
| $T_{60}$ | 807 | 827 |
| $T_{70}$ | 839 | 873 |

TABLE I-continued

| Fischer-Tropsch Wax | | |
|---|---|---|
| $T_{80}$ | 870 | 914 |
| $T_{90}$ | 911 | 965 |
| $T_{95}$ | 935 | 1005 |
| $T_{99.5}$ | 978 | 1090 |

*duplicate tests

The Fischer-Tropsch waxes had a weight ratio of compounds having at least 60 carbons atoms to compounds having at least 30 carbon atoms of less than 0.18 and a $T_{90}$ boiling point between 900° F. and 1000° F. Three samples of the Fischer-Tropsch waxes (one sample of FT Wax A and two samples of FT Wax B) were hydroisomerized over a Pt/SAPO-11 catalyst on an alumina binder. Operating conditions included temperatures between 652° F. and 695° F. (315° C. and 399° C.), LHSVs of 0.6 to 1.0 $hr^{-1}$, reactor pressure of 1000psig, and once-through hydrogen rates of between 6 and 7 MSCF/bbl. The reactor effluent passed directly to a second reactor containing a Pt/Pd on silica-alumina hydrofinishing catalyst also operated at 1000 psig. Conditions in the second reactor included a temperature of 450° F. (232° C.) and an LHSV of 1.0 $hr^{-1}$.

The products boiling above 650° F. were fractionated by atmospheric or vacuum distillation to produce distillate fractions of different viscosity grades.

Three Fischer-Tropsch derived lubricant base oil fractions were obtained: FT-4A (from FT Wax A) and FT-2B and FT-8B (both from FT Wax B). As such, FT Wax A was used to make a 4.5 cSt Fischer-Tropsch derived lubricant base oil fraction (FT-4A) and FT Wax B was used to make a 2.5 cSt Fischer-Tropsch derived lubricant base oil fraction (FT-2B) and an 8 cSt Fischer-Tropsch derived lubricant base oil fraction (FT-8B). Test data on specific fractions useful as the Fischer-Tropsch derived lubricant base oil fraction are shown below in Table II.

TABLE II

Properties of Fischer-Tropsch Derived Lubricating Base Oil Fractions

| Properties | FT-2B | FT-4A | FT-8B |
|---|---|---|---|
| Viscosity at 100° C., cSt | 2.583 | 4.455 | 7.953 |
| Viscosity Index | 133 | 147 | 165 |
| Aromatics, Wt % | 0.0046 | 0.0022 | Not tested |
| FIMS, Wt % of Molecules | | | |
| Paraffins | 93.0 | 89.1 | 87.2 |
| Monocycloparaffins | 7.0 | 10.9 | 12.6 |
| Multicycloparaffins | 0.0 | 0.0 | 0.2 |
| Total | 100 | 100.0 | 100.0 |

TABLE II-continued

Properties of Fischer-Tropsch Derived Lubricating Base Oil Fractions

| Properties | FT-2B | FT-4A | FT-8B |
|---|---|---|---|
| Pour Point, ° C. | −30 | −20 | −12 |
| Cloud Point, ° C. | −9 | −8 | +13 |
| Ratio of Mono/Multicycloparaffins | >70 | >100 | 61 |
| Noack Volatility, Wt % | 48.94 | 10.75 | |
| Oxidator BN, Hours | 40.14 | 46.05 | |
| SIM DIS (Wt %), ° F. | | | |
| 5 | 618 | 742 | 824 |
| 10 | 630 | 763 | 830 |
| 20 | 653 | 784 | 846 |
| 30 | 673 | 797 | 877 |
| 50 | 713 | 823 | 919 |
| 70 | 754 | 854 | 977 |
| 90 | 802 | 896 | 1076 |
| 95 | 816 | 913 | 1120 |

Example 2

Preparation of Lubricant Blends

The Fischer-Tropsch derived lubricant base oil fractions prepared above (FT-2B, FT-4A, and FT-8B) were used to make lubricant blends with petroleum base oils. The Petroleum Base Oils used to blend with the Fischer-Tropsch derived lubricant base oils fractions are as follows:

TABLE III

Petroleum Base Oils

| Properties | Group I Medium Neutral | Group I Heavy Neutral | Group II Medium Neutral | Group II Heavy Neutral |
|---|---|---|---|---|
| Description | ExxonMobil AC330 | ExxonMobil AC600 | ChevronTexaco 220R | ChevronTexaco 600R |
| Viscosity at 100° C. | 7.998 | 12.25 | 6.502 | 12.37 |
| Viscosity Index | 98 | 98 | 103 | 100 |
| Pour Point, ° C. | −9 | −8 | −14 | −16 |

Four different blends of FT-2B with the petroleum derived Group I or Group II base oils summarized in the table above, and polymethacrylate pour point depressant were prepared. All four of these lubricant blends had kinematic viscosities within one of the preferred ranges of about 3 cSt or greater and less than 5.0 cSt.

TABLE IV

Lubricant Blends with FT-2B

| | w/Group I Medium Neutral | w/Group I Heavy Neutral | w/Group II Medium Neutral | w/Group II Heavy Neutral |
|---|---|---|---|---|
| Components, Wt % | | | | |
| FT-2.5 | 55.83(56) | 66.8(67) | 46.86(47) | 67(67.2) |
| Group I Med Neutral | 43.87(44) | | | |
| Group I Heavy Neutral | | 32.9(33) | | |
| Group II Med Neutral | | | 52.84(53) | |

TABLE IV-continued

| | Lubricant Blends with FT-2B | | | |
|---|---|---|---|---|
| | w/Group I Medium Neutral | w/Group I Heavy Neutral | w/Group II Medium Neutral | w/Group II Heavy Neutral |
| Group II Heavy Neutral | | | | 32.7(32.8) |
| Pour Point Depressant | 0.3 | 0.3 | 0.3 | 0.3 |
| TOTAL | 100.0 | 100.0 | 100.0 | 100.0 |
| Brookfield Viscosity @−40° C., cP | 82,000 | 36,250 | 10,500 | 17,000 |
| Kinematic Vis @ 40° C. | 17.02 | 16.5 | 17.64 | 16.6 |
| Kinematic Vis @ 100° C. | 3.884 | 3.881 | 3.956 | 3.904 |
| Viscosity Index | 123 | 132 | 121 | 133 |

All of these blends had Brookfield viscosities at −40° C. below 100,000. It was surprising that the blends with petroleum derived Group II base oils had substantially lower Brookfield viscosities than the blends with Group I base oils. It is expected that blends with petroleum derived Group III base oils would give results as good or better than the blends with petroleum derived Group II base oils. The results of the blends using the 2.5 cSt Fischer-Tropsch derived lubricant base oil fraction (FT-2B) are illustrated in FIG. 1.

Five different lubricant blends were made using FT-4A. An all FT Blend with FT-4A, FT-8, and polymethacrylate pour point depressant was made for comparison. The other four blends were made with FT-4A, the petroleum derived Group I or Group II base oils detailed above, and polymethacrylate pour point depressant. All four of these lubricant blends had kinematic viscosities within one of the preferred ranges of about 5.0 cSt or greater and less than 6.5 cSt. The properties of these blends are summarized below.

The comparison lubricant blend with all Fischer-Tropsch derived lubricant base oil fractions and polymethacrylate pour point depressant had an unacceptably high Brookfield viscosity at −40° C., greater than a million cP. The blends of FT-4A with petroleum derived Group I base oils had Brookfield viscosities at −40° C. above 100,000 cP so were not optimal. The blends with petroleum derived Group II base oil had Brookfield viscosities at −40° C. well below 100,000 cP, making them suitable lubricant blends of this invention. As with the blends with FT-2B, the blends with petroleum derived Group II base oils had significantly lower Brookfield viscosities than the blends with petroleum derived Group I base oils. As with the FT-2B blends, it is expected that blends of FT-4A with petroleum derived Group III base oils and pour point depressant would give results as good or better than the blends with petroleum derived Group II base

TABLE V

Figure 2:
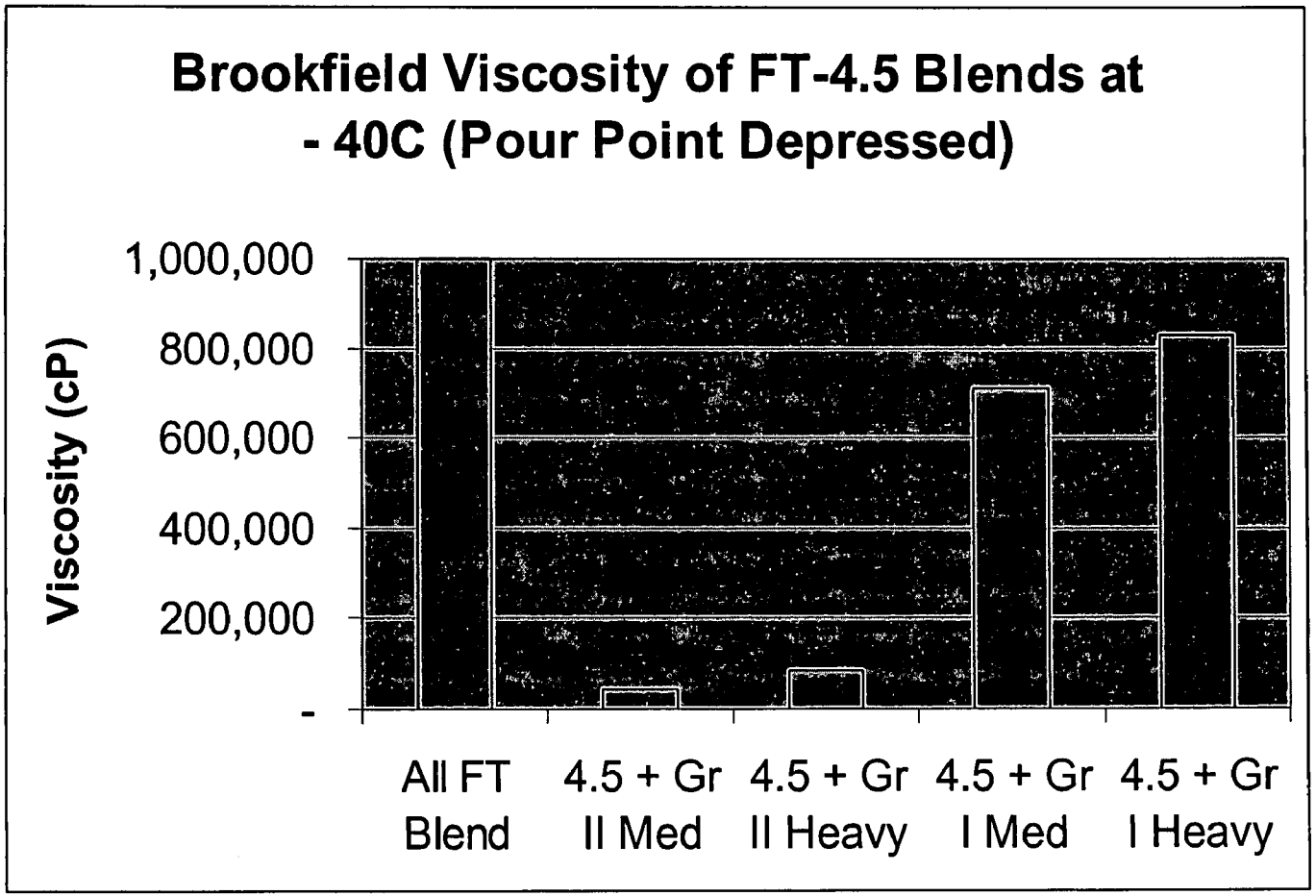
FIG. 2 illustrates the results of lubricant blends using a 4.5 cSt Fischer-Tropsch derived fraction (FT-4A).

| | Lubricant Blends with FT-4A | | | | |
|---|---|---|---|---|---|
| | All FT Blend | w/Group I Medium Neutral | w/Group I Heavy Neutral | w/Group II Medium Neutral | w/Group II Heavy Neutral |
| Components, Wt % | | | | | |
| FT-4A | 55.7 | 55.8 | 66.8 | 46.9 | 67.0 |
| FT-8 B | 44.0 | | | | |
| Group I Medium Neutral | | 43.9 | | | |
| Group I Heavy Neutral | | | 32.9 | | |
| Group II Medium Neutral | | | | 52.8 | |
| Group II Heavy Neutral | | | | | 32.7 |
| Pour Point Depressant | 0.3 | 0.3 | 0.3 | 0.3 | 0.3 |
| TOTAL | 100.0 | 100.0 | 100.0 | 100.0 | 100.0 |
| Brookfield Viscosity @−40° C., cP | >1,000,000 | 709,000 | 830,000 | 45,450 | 83,000 |
| Kinematic Vis @ 40° C. | 27.24 | 28.87 | 30.38 | 27.59 | 30.57 |
| Kinematic Vis @ 100° C. | 5.778 | 5.514 | 5.841 | 5.312 | 5.888 |
| Viscosity Index | 162 | 131 | 139 | 128 | 139 |

oils. The results of the blends using the 4.5 cSt Fischer-Tropsch derived lubricant base oil fraction (FT-4A) are illustrated in FIG. 2.

Example 3

Comparative Example

A sample of hydrotreated Fischer-Tropsch wax, FT Wax C, was made using a Fe-based Fischer-Tropsch catalyst. The sample, FT Wax C, was analyzed and found to have the properties shown in Table VI.

TABLE VI

| FT Wax C | |
|---|---|
| | FT Wax C |
| Sulfur, ppm | <2 |
| Nitrogen, ppm | <8 |
| Oxygen by Neutron Activation, Wt % | 0.15 |
| Oil Content, D 721, Wt % | <1 |
| Average Carbon Number | 41.6 |
| Average Molecular Weight | 585.4 |
| D 6352 SIMDIST TBP (WT %), ° F. | |
| T0.5 | 784 |
| T5 | 853 |
| T10 | 875 |
| T20 | 914 |
| T30 | 941 |
| T40 | 968 |
| T50 | 995 |
| T60 | 1013 |
| T70 | 1031 |
| T80 | 1051 |
| T90 | 1081 |
| T95 | 1107 |
| T99.5 | 1133 |

A sample of the FT Wax C was hydroisomerized over a Pt/SAPO-11 catalyst on an alumina binder. Operating conditions included temperatures between 652° F. and 695° F. (315° C. and 399° C.), LHSVs of 1.0 $hr^{-1}$, reactor pressure of 1000 psig, and once-through hydrogen rates of between 6 and 7 MSCF/bbl. The reactor effluent passed directly to a second reactor containing a Pt/Pd on silica-alumina hydrofinishing catalyst also operated at 1000 psig. Conditions in the second reactor included a temperature of 450° F. (232° C.) and an LHSV of 1.0 $hr^{-1}$.

The products boiling above 650° F. were fractionated by atmospheric or vacuum distillation to produce two fractions of different viscosity grades.

As such, a 6.3 cSt Fischer-Tropsch derived lubricant base oil fraction (FT-6.3) and a 14.6 cSt Fischer-Tropsch derived lubricant base oil fraction (FT-14.6) were obtained. The properties of the two Fischer-Tropsch derived lubricant base oil fractions are shown below in Table VII:

TABLE VII

| Fischer-Tropsch Derived Lubricant Base Oil Fractions | | |
|---|---|---|
| Properties | FT-6.3 | FT-14.6 |
| Viscosity at 100° C., cSt | 6.295 | 14.62 |
| Viscosity Index | 154 | 160 |

TABLE VII-continued

| Fischer-Tropsch Derived Lubricant Base Oil Fractions | | |
|---|---|---|
| Properties | FT-6.3 | FT-14.6 |
| Aromatics, Wt % | 0.0141 | Not tested |
| FIMS, Wt % of Molecules | | |
| Paraffins | 76.0 | 76.0 |
| Monocylcoparaffins | 22.1 | 22.1 |
| Multicycloparaffins | 1.9 | 1.9 |
| Total | 100.0 | 100.0 |
| Pour Point, ° C. | −14 | −1 |
| SIM DIS (Wt %), F. | | |
| T5 | 827 | 977 |
| T10 | 841 | 986 |
| T20 | 863 | 999 |
| T30 | 881 | 1009 |
| T50 | 912 | 1034 |
| T70 | 943 | 1064 |
| T90 | 982 | 1153 |
| T95 | 996 | 1208 |

Neither of FT-6.3 nor FT-14.6 met the desired ratio of weight percent of molecules with monocycloparaffinic functionality to weight percent of molecules with multicycloparaffinic functionality. The ratio for both of these samples was only 11.6.

The Fischer-Tropsch derived lubricant base oil fractions prepared above (FT-6.3 and FT-14.6) were each used to make a lubricant blend with the Group II Heavy Neutral petroleum base oil, as characterized in Table III, and polymethacrylate as the pour point depressant. The composition and properties of the two resulting blends are summarized in Table VIII below.

TABLE VIII

| Lubricant Blends with Group II Heavy Neutral | | |
|---|---|---|
| Components, Wt % | FT-6.3 w/Group II Heavy Neutral | FT-14.6 w/Group II Heavy Neutral |
| FT-6.3 | 19.94 | 0 |
| FT-14.6 | 0 | 19.94 |
| Group II Heavy Neutral | 79.76 | 79.76 |
| Pour Point Depressant | 0.3 | 0.3 |
| Brookfield Viscosity @−40 C., cP | 610,000 | >1,000,000 |
| Kinematic Vis @ 100° C. | 10.47 | 12.75 |
| Viscosity Index | 116 | 119 |

The two resulting blends, made with the Fischer-Tropsch derived lubricant base oil fractions not meeting the desired ratio of weight percent of molecules with monocycloparaffinic functionality to weight percent of molecules with multicycloparaffinic functionality, had Brookfield viscosities at −40° C. significantly above 100,000 cP. These blends also had lower viscosity indexes than what is preferred, that is the viscosity indexes were less than 120. Accordingly, these two blends would not be suitable for use in high quality gear lubricant formulations.

While the present invention has been described with reference to specific embodiments, this application is intended to cover those various changes and substitutions that may be made by those of ordinary skill in the art without departing from the spirit and scope of the appended claims.

What is claimed is:

1. A lubricant blend comprising:

a. from about 10 to about 80 weight percent based upon the total lubricant blend of a Fischer-Tropsch derived lubricant base oil fraction having a viscosity of between about 2 cSt and 20 cSt at 100° C., wherein the Fischer-Tropsch derived lubricant base oil fraction comprises:
(i) less than 0.30 weight percent aromatics;
(ii) greater than 5 weight percent molecules with cycloparaffinic functionality; and
(iii) a ratio of weight percent of molecules with monocycloparaffinic functionality to weight percent of molecules with multicycloparaffinic functionality greater than 15;

b. from about 20 to about 90 weight percent based upon the total lubricant blend of a petroleum derived base oil selected from the group consisting of a Group II base oil, a Group III base oil, and mixtures thereof; and c. from about 0.01 to 12 weight percent based upon the total lubricant blend of a pour point depressant;

wherein the lubricant blend has a viscosity of about 3 cSt or greater at 100° C. and a Brookfield viscosity at −40° C. of less than 100,000 cP.

2. The lubricant blend of claim 1, wherein the lubricant blend has a Brookfield viscosity at −40° C. of less than 50,000 cP.

3. The lubricant blend of claim 1, wherein the lubricant blend has a Brookfield viscosity at −40° C. of less than 25,000 cP.

4. The lubricant blend of claim 1, wherein the lubricant blend has a Brookfield viscosity at −40° C. of less than 15,000 cP.

5. The lubricant blend of claim 1, wherein the lubricant blend has a viscosity of about 3 cSt or greater and less than 5.0 cSt at 100° C.

6. The lubricant blend of claim 1, wherein the lubricant blend has a viscosity of about 5.0 cSt or greater and less than 7.0 cSt at 100° C.

7. The lubricant blend of claim 1, wherein the lubricant blend has a viscosity index greater than 120.

8. The lubricant blend of claim 1, wherein the Fischer-Tropsch derived lubricant base oil fraction has a viscosity of between about 2 cSt and 12 cSt at 100° C.

9. The lubricant blend of claim 1, wherein the Fischer-Tropsch derived lubricant base oil fraction comprises a weight percent of molecules with monocycloparaffinic functionality of greater than 10, and a weight percent of molecules with multicycloparaffinic functionality of less than 0.1.

10. The lubricant blend of claim 1, wherein the Fischer-Tropsch derived lubricant base oil fraction comprises greater than 10 weight percent molecules with cycloparaffinic functionality.

11. The lubricant blend of claim 1, wherein the Fischer-Tropsch derived lubricant base oil fraction comprises a ratio of weight percent of molecules with monocycloparaffinic functionality to weight percent of molecules with multicycloparaffinic functionality greater than 50.

12. The lubricant blend of claim 1, wherein the Fischer-Tropsch derived lubricant base oil fraction has a viscosity of between about 2 cSt and 3 cSt at 100° C.

13. The lubricant blend of claim 12, wherein the lubricant blend has a Brookfield viscosity at −40° C. of less than 35,000 cP.

14. The lubricant blend of claim 1, wherein the Fischer-Tropsch derived lubricant base oil fraction has a viscosity of between about 3 cSt and 6 cSt at 100° C.

15. The lubricant blend of claim 14, wherein the lubricant blend has a Brookfield viscosity at −40° C. of less than 60,000 cP.

16. The lubricant blend of claim 1, wherein the Fischer-Tropsch derived lubricant base oil fraction has a Noack Volatility less than a Noack Volatility Factor as calculated by the following equation:

$$\text{Noack Volatility Factor}=1000(\text{Kinematic Viscosity of the Fischer-Tropsch derived lubricant base oil fraction at } 100^\circ\text{ C.})^{-2.7}.$$

17. The lubricant blend of claim 1, wherein the Fischer-Tropsch derived lubricant base oil fraction has a Noack volatility less than 50 weight percent.

18. The lubricant blend of claim 1, wherein the Fischer-Tropsch derived lubricant base oil has a Viscosity Index greater than a Viscosity Index Factor as calculated by the following equation:

$$\text{Viscosity Index Factor}=28\times 1\text{n}(\text{Kinematic Viscosity of the Fischer-Tropsch derived lubricant base oil fraction at } 100^\circ\text{ C.})95.$$

19. The lubricant blend of claim 1, wherein the Fischer-Tropsch derived lubricant base oil fraction has an Oxidator BN with L-4 Catalyst test result of greater than 25 hours.

20. The lubricant blend of claim 1, wherein the petroleum derived base oil is selected from the group consisting of a base oil having a kinematic viscosity at 100° C. of from about 8 to about 20 cSt, a base oil having a kinematic viscosity at 100° C. of from about 5 to about 8 cSt, and mixtures thereof.

21. The lubricant blend of claim 1, wherein the pour point depressant is selected from the group consisting of esters of maleic anhydride-styrene copolymers, polymethacrylates, polyacrylates, polyacrylamides, condensation products of haloparaffin waxes and aromatic compounds, vinyl carboxylate polymers, and terpolymers of dialkylfumarates, vinyl esters of fatty acids, ethylene-vinyl acetate copolymers, alkyl phenol formaldehyde condensation resins, alkyl vinyl ethers, olefin copolymers, and mixtures thereof.

22. The lubricant blend of claim 1, wherein the pour point depressant is an isomerized Fischer-Tropsch derived bottoms product with an average molecular weight of from about 600 to about 1100 and a 10 percent boiling point range of from about 850° F. to about 1050° F.

23. The lubricant blend of claim 21, wherein the lubricant blend further comprises from about 0.05 to 15 weight percent based upon the total lubricant blend of an isomerized Fischer-Tropsch derived bottoms product.

24. The lubricant blend of claim 1, wherein the pour point depressant is a mixture of an isomerized Fischer-Tropsch derived bottoms product with an average molecular weight of from about 600 to about 1100 and a 10 percent boiling point of from about 850° F. to about 1050° F.; and an additive selected from the group consisting of esters of maleic anhydride-styrene copolymers, polymethacrylates, polyacrylates, polyacrylamides, condensation products of haloparaffin waxes and aromatic compounds, vinyl carboxylate polymers, and terpolymers of dialkylfumarates, vinyl esters of fatty acids, ethylene-vinyl acetate copolymers, alkyl phenol formaldehyde condensation resins, alkyl vinyl ethers, olefin copolymers, and mixtures thereof.

25. The lubricant blend of claim 1, wherein the pour point depressant is polymethacrylate.

26. A lubricant blend comprising:

a. from about 10 to about 80 weight percent based upon the total lubricant blend of a Fischer-Tropsch derived lubricant base oil fraction having a viscosity of between about 2 cSt and 12 cSt at 100° C., wherein the Fischer-Tropsch derived lubricant base oil fraction comprises:

(i) less than 0.30 weight percent aromatics;

(ii) greater than 5 weight percent molecules with cycloparaffinic functionality; and (iii) a ratio of weight percent of molecules with monocycloparaffinic functionality to weight percent of molecules with multicycloparaffinic functionality greater than 15;

b. from about 20 to about 90 weight percent based upon the total lubricant blend of a petroleum derived base oil, wherein the petroleum derived base oil comprises greater than 90 weight percent saturates and less than 300 ppm sulfur; and c. from about 0.01 to 12 weight percent based upon the total lubricant blend of a pour point depressant;

wherein the lubricant blend has a viscosity of about 3 cSt at 100° C. or greater and a Brookfield viscosity at −40° C. of less than 90,000 cP.

27. The lubricant blend of claim 26, wherein the lubricant blend has a Brookfield viscosity at −40° C. of less than 60,000 cP.

28. The lubricant blend of claim 26, wherein the lubricant blend has a Brookfield viscosity at −40° C. of less than 35,000 cP.

29. The lubricant blend of claim 26, wherein the lubricant blend has a Brookfield viscosity at −40° C. of less than 15,000 cP.

30. The lubricant blend of claim 26, wherein the lubricant blend has a viscosity of about 3 cSt or greater and less than 5.0 cSt at 100° C.

31. The lubricant blend of claim 26, wherein the lubricant blend has a viscosity of about 5.0 cSt or greater and less than 7.0 cSt at 100° C.

32. The lubricant blend of claim 26, wherein the lubricant blend has a viscosity index greater than 120.

33. The lubricant blend of claim 26, wherein the Fischer-Tropsch derived lubricant base oil fraction comprises greater than 10 weight percent molecules with cycloparaffinic functionality.

34. The lubricant blend of claim 26, wherein the Fischer-Tropsch derived lubricant base oil fraction comprises a ratio of weight percent of molecules with monocycloparaffinic functionality to weight percent of molecules with multicycloparaffinic functionality greater than 50.

35. The lubricant blend of claim 26, wherein the Fischer-Tropsch derived lubricant base oil fraction has a viscosity of between about 2 cSt and 3 cSt at 100° C.

36. The lubricant blend of claim 35, wherein the lubricant blend has a Brookfield viscosity at −40° C. of less than 35,000 cP.

37. The lubricant blend of claim 26, wherein the Fischer-Tropsch derived lubricant base oil fraction has a viscosity of between about 3 cSt and 6 cSt at 100° C.

38. The lubricant blend of claim 37, wherein the lubricant blend has a Brookfield viscosity at −40° C. of less than 60,000 cP.

39. The lubricant blend of claim 26, wherein the Fischer-Tropsch derived lubricant base oil fraction has a Noack Volatility less than a Noack Volatility Factor as calculated by the following equation:

$$\text{Noack Volatility Factor}=1000(\text{Kinematic Viscosity of the Fischer-Tropsch derived lubricant base oil fraction at } 100^\circ\text{ C.})^{-2.7}.$$

40. The lubricant blend of claim 26, wherein the Fischer-Tropsch derived lubricant base oil fraction has a Noack volatility less than 50 weight percent.

41. The lubricant blend of claim 26, wherein the Fischer-Tropsch derived lubricant base oil has a Viscosity Index greater than a Viscosity Index Factor as calculated by the following equation:

$$\text{Viscosity Index Factor}=28\times 1n(\text{Kinematic Viscosity of the Fischer-Tropsch derived lubricant base oil fraction at } 100^\circ\text{ C.})95.$$

42. The lubricant blend of claim 26, wherein the Fischer-Tropsch derived lubricant base oil fraction has an Oxidator BN with L-4 Catalyst test result of greater than 25 hours.

43. The lubricant blend of claim 26, wherein the petroleum derived base oil is selected from the group consisting of a base oil having a kinematic viscosity at 100° C. of from about 8 to about 20 cSt, a base oil having a kinematic viscosity at 100° C. of from about 5 to about 8 cSt, and mixtures thereof.

44. The lubricant blend of claim 26, wherein the pour point depressant is selected from the group consisting of esters of maleic anhydride-styrene copolymers, polymethacrylates, polyacrylates, polyacrylamides, condensation products of haloparaffin waxes and aromatic compounds, vinyl carboxylate polymers, and terpolymers of dialkylfumarates, vinyl esters of fatty acids, ethylene-vinyl acetate copolymers, alkyl phenol formaldehyde condensation resins, alkyl vinyl ethers, olefin copolymers, and mixtures thereof.

45. The lubricant blend of claim 26, wherein the pour point depressant is an isomerized Fischer-Tropsch derived bottoms product with an average molecular weight of from about 600 to about 1100 and a 10 percent boiling point range of from about 850° F. to about 1050° F.

46. The lubricant blend of claim 26, wherein the pour point depressant is a mixture of an isomerized Fischer-Tropsch derived bottoms product with an average molecular weight of from about 600 to about 1100 and a 10 percent boiling point of from about 850° F. to about 1050° F.; and an additive selected from the group consisting of esters of maleic anhydride-styrene copolymers, polymethacrylates, polyacrylates, polyacrylamides, condensation products of haloparaffin waxes and aromatic compounds, vinyl carboxylate polymers, and terpolymers of dialkylfumarates, vinyl esters of fatty acids, ethylene-vinyl acetate copolymers, alkyl phenol formaldehyde condensation resins, alkyl vinyl ethers, olefin copolymers, and mixtures thereof.

47. A gear oil comprising the lubricant blend of claim 1 and at least one additive in addition to the pour point depressant.

48. The gear oil of claim 47, wherein the at least one additive in addition to the pour point depressant is selected from the group consisting of antiwear additives, EP agents, detergents, dispersants, antioxidants, viscosity index improvers, ester co-solvents, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, thickeners, and combinations thereof.

49. A gear oil comprising the lubricant blend of claim 26 and at least one additive in addition to the pour point depressant.

50. The gear oil of claim 49, wherein the at least one additive in addition to the pour point depressant is selected from the group consisting of antiwear additives, EP agents, detergents, dispersants, antioxidants, viscosity index improvers, ester co-solvents, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, thickeners, and combinations thereof.

* * * * *

UNITED STATES PATENT AND TRADEMARK OFFICE

CERTIFICATE OF CORRECTION

PATENT NO. : 7,273,834 B2
APPLICATION NO. : 10/847997
DATED : September 25, 2007
INVENTOR(S) : John M. Rosenbaum, Stephen J. Miller and Joseph M. Pudlak It is certified that error appears in the above-identified patent and that said Letters Patent is hereby corrected as shown below:

In the Claims:

In column 36, line 10, please delete "oil fraction at 100°C.)95"

and insert --oil fraction at 100°C.)+95-- in place thereof.

Signed and Sealed this

Twenty-eighth Day of July, 2009

John Doll

JOHN DOLL
*Acting Director of the United States Patent and Trademark Office*